US012434934B2

(12) United States Patent
Yang

(10) Patent No.: US 12,434,934 B2
(45) Date of Patent: Oct. 7, 2025

(54) AUTOMATIC ROLL REPLACING DEVICE, AND WINDING EQUIPMENT

(71) Applicant: WUXI LEAD INTELLIGENT EQUIPMENT CO., LTD., Jiangsu (CN)

(72) Inventor: Xiaofei Yang, Jiangsu (CN)

(73) Assignee: WUXI LEAD INTELLIGENT EQUIPMENT CO., LTD., Jiangsu (CN)

( * ) Notice: Subject to any disclaimer, the term of this patent is extended or adjusted under 35 U.S.C. 154(b) by 680 days.

(21) Appl. No.: 17/787,321

(22) PCT Filed: Oct. 20, 2020

(86) PCT No.: PCT/CN2020/122063
§ 371 (c)(1),
(2) Date: Jun. 19, 2022

(87) PCT Pub. No.: WO2021/129077
PCT Pub. Date: Jul. 1, 2021

(65) Prior Publication Data

US 2022/0356025 A1 Nov. 10, 2022

(30) Foreign Application Priority Data

Dec. 24, 2019 (CN) ..... 201922346679.0
Dec. 24, 2019 (CN) ..... 201922347380.7
(Continued)

(51) Int. Cl.
*B65H 19/12* (2006.01)
*B65H 19/18* (2006.01)
(Continued)

(52) U.S. Cl.
CPC ..... *B65H 19/12* (2013.01); *B65H 19/123* (2013.01); *B65H 19/181* (2013.01);
(Continued)

(58) Field of Classification Search
CPC .... B65H 19/12; B65H 9/123; B65H 19/1873; B65H 19/18; B65H 19/181;
(Continued)

(56) References Cited

U.S. PATENT DOCUMENTS 3,718,302 A * 2/1973 Mount ..... B65H 19/30 242/533.3
3,845,915 A * 11/1974 Schmidt ..... B29C 53/32 242/596.5
(Continued)

FOREIGN PATENT DOCUMENTS

CN 107310959 A 11/2017
CN 108313797 A * 7/2018 ..... B65H 19/1842
(Continued)

OTHER PUBLICATIONS

International Search Report and the Written Opinion Dated Jan. 26, 2021 From the International Searching Authority Re. Application No. PCT/CN2020/122063 and Its Translation of Search Report Into English (3 Pages).
(Continued)

*Primary Examiner* — Anna M Momper
*Assistant Examiner* — Raveen J Dias
(74) *Attorney, Agent, or Firm* — Rivka Friedman

(57) ABSTRACT

Disclosed in the present application are an automatic roll replacing device, and winding equipment. The automatic roll replacing device includes: a mounting frame; an unwinding mechanism, including an unwinding shaft rotatably connected to the mounting frame around its own axis; a spare material mechanism, including a spare material shaft
(Continued)

having a contact end and a material pushing member providing an axial pushing force for a spare material roll on the spare material shaft, the spare material shaft being rotatably connected to the mounting frame around the rotation axis, and the material pushing member being controlled to push the spare material roll on the spare material shaft to transfer to the unwinding shaft; and a strip connection mechanism, provided on the mounting frame, and used for cutting off a work material strip unwound from the unwinding shaft and connecting the cut-off work material strip to the spare material roll.

20 Claims, 15 Drawing Sheets

(30) Foreign Application Priority Data

Dec. 24, 2019 (CN) ..... 201922347396.8
Dec. 24, 2019 (CN) ..... 201922347901.9
Dec. 24, 2019 (CN) ..... 201922347936.2
Dec. 24, 2019 (CN) ..... 201922349406.1

(51) Int. Cl.
*B65H 19/20* (2006.01)
*B65H 19/30* (2006.01)

(52) U.S. Cl.
CPC ..... *B65H 19/1842* (2013.01); *B65H 19/1863* (2013.01); *B65H 19/1873* (2013.01); *B65H 19/1878* (2013.01); *B65H 19/20* (2013.01); *B65H 19/30* (2013.01); *B65H 2301/4171* (2013.01); *B65H 2301/41745* (2013.01); *B65H 2301/41828* (2013.01); *B65H 2301/41829* (2013.01); *B65H 2301/4185* (2013.01); *B65H 2301/41858* (2013.01); *B65H 2301/46* (2013.01); *B65H 2801/72* (2013.01)

(58) Field of Classification Search
CPC ..... B65H 19/1815; B65H 9/1842; B65H 19/1847; B65H 19/1878; B65H 19/1857; B65H 19/1863; B65H 19/1868; B65H 19/20; B65H 19/30; B65H 2301/417; B65H 2301/4171; B65H 2301/4173; B65H 2301/4175; B65H 2301/41828; B65H 2301/41829; B65H 2301/4185; B65H 2301/41858; B65H 2301/4132; B65H 2301/413223; B65H 2301/41324; B65H 2301/413243; B65H 2301/46; B65H 2301/461; B65H 2301/4611; B65H 2301/46115; B65H 2301/44338; B65H 2404/73; B65H 2404/74; B65H 2404/741; B65H 2801/72; B65H 2701/11332
USPC ..... 242/559, 559.3, 560, 560.1, 560.2
See application file for complete search history.

(56) References Cited

U.S. PATENT DOCUMENTS 4,009,841 A * 3/1977 Matalia ..... B65H 19/1815 242/555.6
4,506,842 A * 3/1985 Beck ..... B65H 19/181 242/554.6
4,589,811 A * 5/1986 Riccardo ..... B65H 19/123 198/463.6
4,660,574 A * 4/1987 Kobayashi ..... B65H 19/123 131/105
4,668,328 A * 5/1987 Kyytsonen ..... B65H 19/1878 156/159
4,681,505 A * 7/1987 Kobayashi ..... B65H 75/2484 414/744.6
4,821,972 A * 4/1989 Grollimund ..... B65H 19/123 901/6
4,896,842 A * 1/1990 Heinz ..... B65B 41/12 242/559.3
4,934,624 A * 6/1990 Grollimund ..... B65H 19/123 414/736
5,205,505 A * 4/1993 Focke ..... B65B 41/12 242/559.3
5,285,978 A * 2/1994 Sakano ..... B65H 19/123 242/562
5,288,034 A * 2/1994 Schonmeier ..... B65H 19/1847 242/551
5,381,983 A * 1/1995 Sakano ..... B65H 19/123 242/562.1
5,423,496 A * 6/1995 Roder ..... B65H 19/1815 242/555.5
5,490,756 A * 2/1996 Reichert ..... B21C 47/242 414/626
5,562,038 A * 10/1996 Bierbaum ..... B65H 19/1873 226/46
6,056,232 A * 5/2000 Karaki ..... G03B 27/588 242/559.3
6,276,628 B1 * 8/2001 Focke ..... B21C 47/242 414/427
6,565,034 B1 * 5/2003 Hesse ..... B65H 19/1847 242/556.1
7,138,033 B2 * 11/2006 Hayasaka ..... B65H 19/1852 156/304.3
7,980,504 B2 * 7/2011 Butterworth ..... B65H 19/1847 242/555.3
8,991,739 B2 * 3/2015 Niwa ..... B65H 19/26 242/566
2002/0054811 A1 * 5/2002 Lofgren ..... B21C 47/242 414/910
2002/0067979 A1 * 6/2002 Ichikawa ..... B65H 19/123 414/334
2003/0034419 A1 * 2/2003 Joutsjoki ..... B65H 19/126 242/533.7
2005/0150990 A1 * 7/2005 Schmidt-Hebbel .... B65H 19/12 242/533.7
2009/0242686 A1 * 10/2009 Oelen ..... B65H 19/181 242/555.3
2014/0209249 A1 * 7/2014 Bevilacqua ..... B65H 19/123 156/539
2015/0034758 A1 * 2/2015 Acciari ..... B65H 23/1825 242/555.4
2016/0060059 A1 * 3/2016 Macura ..... B65H 19/123 242/555.1
2016/0060060 A1 * 3/2016 Macura ..... B65H 16/04 242/558
2016/0060061 A1 * 3/2016 Macura ..... B25J 15/0047 242/559
2017/0137247 A1 * 5/2017 Sato ..... B65H 19/1842
2017/0233206 A1 * 8/2017 Wimmer ..... B65H 19/123 242/554
2017/0247214 A1 * 8/2017 Wimmer ..... B65H 19/12
2017/0327336 A1 * 11/2017 Vergentini ..... B65H 19/12
2018/0141772 A1 * 5/2018 Prankl ..... B65H 19/12
2019/0315587 A1 * 10/2019 Nagafuchi ..... B65H 19/12
2019/0337747 A1 * 11/2019 Nagafuchi ..... B65H 16/04
2021/0139264 A1 * 5/2021 Badini ..... B65H 19/123
2021/0292120 A1 * 9/2021 Li ..... B65H 19/1847
2023/0010608 A1 * 1/2023 Sale ..... B65H 19/123
2023/0123540 A1 * 4/2023 Cao ..... B65H 19/30 242/532.3
2024/0002184 A1 * 1/2024 Yang ..... B65H 19/12
2024/0076156 A1 * 3/2024 Yang ..... B65H 35/0013

FOREIGN PATENT DOCUMENTS

CN 109399291 A * 3/2019 ..... B65H 19/12
CN 109399292 A * 3/2019 ..... B65H 19/12

(56) References Cited

FOREIGN PATENT DOCUMENTS

| | | | | | |
|---|---|---|---|---|---|
| CN | 109399293 | A | * | 3/2019 | ..... B65H 19/18 |
| CN | 109677971 | A | * | 4/2019 | ..... B65H 19/12 |
| CN | 110182638 | A | * | 8/2019 | ..... B65H 19/1805 |
| CN | 209367457 | U | | 9/2019 | |
| CN | 209411407 | U | | 9/2019 | |
| CN | 110304438 | A | | 10/2019 | |
| CN | 111056346 | A | | 4/2020 | |
| CN | 111056347 | A | | 4/2020 | |
| CN | 111056348 | A | | 4/2020 | |
| CN | 211594402 | U | | 4/2020 | |
| DE | 10051036 | A1 | | 4/2002 | |
| EP | 3181500 | A1 | | 6/2017 | |
| JP | 2574459 | B2 | * | 1/1997 | ..... B65H 19/123 |
| JP | 2012101866 | A | | 5/2012 | |
| JP | 2013199358 | A | | 10/2013 | |
| JP | 2019077545 | A | | 5/2019 | |

OTHER PUBLICATIONS

European Extended Search Report issued in corresponding Chinese Patent Application No. 20908337.7 dated Apr. 30, 2024.

* cited by examiner

AUTOMATIC ROLL REPLACING DEVICE, AND WINDING EQUIPMENT

CROSS-REFERENCE TO RELATED APPLICATION

This disclosure claims priorities to a Chinese patent application with an application date of Dec. 24, 2019, an application number of "201922347380.7", and an application title of "STRIP CONNECTION MECHANISM, AUTOMATIC ROLL REPLACING DEVICE AND WINDING EQUIPMENT"; a Chinese patent application with an application date of Dec. 24, 2019, an application number of "201922349406.1", and an application title of "AUTOMATIC ROLL REPLACING DEVICE AND WINDING EQUIPMENT"; a Chinese patent application with an application date of Dec. 24, 2019, an application number of "201922347396.8", and an application title of "WASTE COLLECTING MECHANISM, AUTOMATIC ROLL REPLACING DEVICE AND WINDING EQUIPMENT"; a Chinese patent application with an application date of Dec. 24, 2019, an application number of "201922347936.2", and an application title of "STRIP CONNECTION MECHANISM, AUTOMATIC ROLL REPLACING DEVICE AND WINDING EQUIPMENT"; a Chinese patent application with an application date of Dec. 24, 2019, an application number of "201922347901.9", and an application title of "UNWINDING MECHANISM, AUTOMATIC ROLL REPLACING DEVICE AND WINDING EQUIPMENT"; and a Chinese patent application with an application date of Dec. 24, 2019, an application number of "201922346679.0", and an application title of "SPARE MATERIAL MECHANISM, AUTOMATIC ROLL REPLACING DEVICE AND WINDING EQUIPMENT"; which are incorporated by reference in the present application in its entirety.

BACKGROUND OF THE DISCLOSURE

Technical Field

The present disclosure relates to a technical field of battery manufacturing equipment, and in particular, to an automatic roll replacing device and a winding equipment.

Description of the Prior Art

In a manufacturing process of lithium batteries, winding of cathode/anode sheets is required. When pole piece material roll is used up, it is necessary to enable a spare material roll to complete an automatic roll replacing process. An automatic roll replacing device can implement cutting and separating a strip material in use from its material roll, and at a same time, connecting a front end of the strip material of the spare material roll with a tail end of the strip material in use. In order to ensure reliability of connection, the front end of the strip material of the spare material roll is provided with an adhesive tape for bonding with the tail end of the strip material in use.

It is necessary for an automatic roll replacing device in the prior art to provide two unwinding mechanisms that are spare for each other generally, that is also to say, when one of the unwinding mechanisms is working normally, another unwinding mechanism is on standby, resulting in a complex structure of the automatic roll replacing device and large occupied space.

BRIEF SUMMARY OF THE DISCLOSURE

In view of this, the present application discloses an automatic roll replacing device and a winding equipment, so as to solve a technical problem that an existing automatic roll replacing device has a complex structure and large occupied space.

An automatic roll replacing device, comprises:

a mounting frame;

an unwinding mechanism, comprising an unwinding shaft rotatably connected to the mounting frame around its own axis;

a spare material mechanism, comprising a spare material shaft having a contact end and a material pushing member providing axial pushing force for a spare material roll on the spare material shaft, the spare material shaft is rotatably connected to the mounting frame around a rotation axis; a material pushing position is provided during a process of the spare material shaft rotating around the rotation axis, when the spare material shaft is located at the material pushing position, the contact end contacts the unwinding shaft, the material pushing member is controlled to push the spare material roll on the spare material shaft to transfer to the unwinding shaft; and a strip connection mechanism, provided on the mounting frame, and used to cut off a work material strip unwound from the unwinding shaft and connect the cut-off work material strip to the spare material roll.

The above-mentioned automatic roll replacing device, when work material rolls on the unwinding shaft are used up and new material rolls are needed to be replaced, firstly use the strip connection mechanism to cut off the work material strip unwound from the unwinding shaft, and release a material barrel from the unwinding shaft (the material roll includes a material barrel and a material strip wound on the material barrel). Then the spare material shaft rotates around the rotation axis, so that the contact end of the spare material shaft is mated with the unwinding shaft, and then the material pushing member pushes the spare material roll on the spare material shaft to transfer to the unwinding shaft. Finally, use the strip connection mechanism to connect the cut-off work material strip to the spare material roll on the unwinding shaft, so as to realize automatic roll replacing. This way, compared with the automatic roll replacing device in the prior art, which needs to be equipped with two sets of unwinding mechanisms on standby for each other, the automatic roll replacing device of the present application utilizes the spare material shaft and the material pushing member to push the spare material roll on the spare material shaft to the unwinding shaft, and does not need to be equipped with two sets of unwinding mechanisms, thereby greatly simplifying a structure of the automatic roll replacing device, and reducing occupied space.

According to an embodiment of the present disclosure, the unwinding shaft is movable relative to the mounting frame.

According to an embodiment of the present disclosure, the unwinding mechanism further comprises a first guiding post, a rotating shaft, a first driving component, and a second driving component;

the first guiding post is movably connected to the mounting frame along its own axis, the rotating shaft is fixed in an axial direction and is rotatably fitted in the first guiding post in a circumferential direction, the unwinding shaft is fixedly connected to one end of the rotating shaft;

the first driving component is disposed on the mounting frame, and is connected with the first guiding post by transmission; the second driving component is disposed on the first guiding post, and is connected with another end of the rotating shaft by transmission, so as to drive the rotating shaft to rotate around its own axis.

According to an embodiment of the present disclosure, the unwinding mechanism further comprises a conveying roller component, the conveying roller component comprises a second guiding post and a conveying roller, the second guiding post is movably connected to the mounting frame along a direction in parallel with the first guiding post, and the second guiding post and the first guiding post are controllably connected to or separated from each other;

the conveying roller is mounted on the second guiding post, and is used to guide a material strip unwound from the unwinding shaft.

According to an embodiment of the present disclosure, a driving portion is fixedly connected to the first guiding post, a mounting member is fixedly connected to the second guiding post;

the conveying roller component further comprises a fixing holding member and a movable holding member, the fixing holding member is mounted on the mounting member, and abuts against one side of the driving portion; the movable holding member is movably connected to the mounting member, and the movable holding member can abut against another side of the driving portion during a moving process.

According to an embodiment of the present disclosure, the conveying roller component further comprises a first sliding rail and a first driving member;

the first sliding rail is fixedly connected to the mounting member, the movable holding member is disposed on the first sliding rail, and is movable along the first sliding rail; the first driving member is fixedly connected to the mounting member, and is connected with the movable holding member by transmission.

According to an embodiment of the present disclosure, one side of the driving portion facing the movable holding member is provided with a mating groove which can be mated with the movable holding member.

According to an embodiment of the present disclosure, the conveying roller component further comprises a locking member fixedly connected to the mounting member and a locking lever fixedly connected to the mounting frame, the locking lever is parallel to the second guiding post, the locking member is controllably connected to or separated from the locking lever.

According to an embodiment of the present disclosure, the first driving component comprises a first lead screw, a first lead screw nut, and sliding member;

one end of the first lead screw nut is rotatably connected to the mounting frame around its own axis, and is parallel to the first guiding post, the first lead screw nut is threadedly connected to the first lead screw, the sliding member is fixedly connected to the first guiding post and the first lead screw nut.

According to an embodiment of the present disclosure, the unwinding mechanism further comprises a guiding component, the guiding component comprises a supporting base, a rotating wheel, guiding driving member, a rotating arm, and a guiding roller;

the supporting base is fixedly mounted on the mounting frame, and provides a shaft hole for the first guiding post to pass through; the rotating wheel is rotatably connected to the supporting base around an axis of the shaft hole; the guiding driving member is mounted on the mounting frame, and is connected with the rotating wheel by transmission; one end of the rotating arm is fixedly connected to the rotating wheel; and the guiding roller is disposed on another end of the rotating arm.

According to an embodiment of the present disclosure, the automatic roll replacing device further comprises a pushing mechanism, the pushing mechanism comprises a pushing shaft and a pushing member, the pushing shaft is rotatably connected to the mounting frame around its own axis, the pushing member is mounted on the pushing shaft;

a pushing position is provided during a process of the pushing shaft being rotatably connected to the mounting frame around its own axis; when the pushing member is located at the pushing position, the pushing member is located between the unwinding shaft and the spare material shaft, and is used to push the spare material roll on the unwinding shaft.

According to an embodiment of the present disclosure, the spare material mechanism further comprises a pushing block, the spare material shaft is further provided with a pushing end opposite to the contact end, the pushing block is fixedly connected to the pushing end;

a spare material position is further provided in a process of the spare material shaft rotating around the rotation axis; when the spare material shaft is located at the spare material position, the pushing block faces the unwinding shaft, so as to push the spare material roll on the unwinding shaft.

According to an embodiment of the present disclosure, the automatic roll replacing device further comprises a waste collecting mechanism, the waste collecting mechanism comprises a grabbing component rotatably connected to the mounting frame around a first axis;

a grabbing position and a discharge position are provided during a process of the grabbing component being rotatably connected to the mounting frame around the first axis, when the grabbing component is located at the grabbing position, the grabbing component is used to grab a material barrel on the unwinding shaft; when the grabbing component is located at the discharge position, the grabbing component releases the material barrel.

According to an embodiment of the present disclosure, the grabbing component comprises a rotary shaft, a second driving member, a first swing arm, and a gripper; the rotary shaft is rotatably disposed around its own axis, the second driving member is connected with the rotary shaft by transmission, one end of the first swing arm is fixedly connected to the rotary shaft, the gripper is disposed on another end of the first swing arm.

According to an embodiment of the present disclosure, the grabbing component further comprises a first sliding block and a third driving member, the first sliding block is slidably connected to the first swing arm, the gripper is disposed on the first sliding block, the third driving member is disposed on the first swing arm, and is connected with the gripper by transmission.

According to an embodiment of the present disclosure, the waste collecting mechanism further comprises a storage component, the storage component is located below the grabbing component, the storage component comprises a sliding seat, the sliding seat is provided with a plurality of material storage areas at intervals in a first direction, the sliding seat is slidably disposed along the first direction, so as to drive the plurality of material storage areas to sequentially move below the discharge position.

According to an embodiment of the present disclosure, the storage component further comprises a second lead screw and a fourth driving member, the second lead screw is rotatably disposed around its own axis, the sliding seat is threadedly connected to the second lead screw, and the fourth driving member is connected with the second lead screw by transmission.

According to an embodiment of the present disclosure, the storage component further comprises a guiding lever, the guiding lever is fixedly disposed along a direction in parallel with the second lead screw, the sliding seat is slidably connected to the guiding lever.

According to an embodiment of the present disclosure, the storage component further comprises two supporting levers, two of the supporting levers are fixedly connected to the sliding seat, two of the supporting levers are disposed at intervals and are parallel to the first direction, material storage space for carrying the material barrel is formed between the two of the supporting levers, the material storage space comprises a plurality of material storage areas disposed along the first direction.

According to an embodiment of the present disclosure, the storage component further comprises a plurality of spacers, the plurality of spacers are fixedly connected to two of the supporting levers, and are disposed at intervals along a longitudinal direction of the supporting levers, so as to separate the plurality of material storage areas.

According to an embodiment of the present disclosure, the spare material shaft is a hollow shaft, at least one chute is defined on a circumferential side wall of the spare material shaft, the chute extends longitudinally along an axial direction of the spare material shaft;

the material pushing member is slidably disposed in the spare material shaft along the axial direction of the spare material shaft, and extends out of the spare material shaft from the corresponding chute.

According to an embodiment of the present disclosure, the spare material mechanism further comprises a material pushing driving component, the material pushing driving component comprises a material pushing lead screw, a material pushing lead screw nut, and a material pushing driving member;

the material pushing lead screw is disposed in the spare material shaft, and is rotatable relative to the spare material shaft, the material pushing lead screw nut is threadedly connected to the material pushing lead screw, the material pushing member and the material pushing lead screw nut are relatively fixedly disposed, the material pushing driving member is mounted on one end of the spare material shaft, and is connected with the material pushing lead screw by transmission.

According to an embodiment of the present disclosure, the material pushing driving component further comprises a driving wheel fixedly sleeved outside of the material pushing lead screw nut, the material pushing member is fixedly connected to the driving wheel;

the material pushing driving component further comprises a material pushing guiding lever fixedly installed in the spare material shaft, the material pushing guiding lever is parallel to an axis of the spare material shaft, and penetrates through the driving wheel, the driving wheel can slide along the material pushing guiding lever; or the driving wheel is slidably fitted to a circumferential inner wall of the spare material shaft.

According to an embodiment of the present disclosure, the spare material mechanism further comprises a first sensor, a peripheral side of the spare material shaft is provided with a detection port, the first sensor is mounted on the detection port, which is used to detect a position of the driving wheel.

According to an embodiment of the present disclosure, the spare material shaft is provided with at least one spare material position along its axial direction for the spare material roll sleeved, each of the spare material positions is provided with a second sensor, the second sensor is used to detect whether the corresponding spare material position is sleeved by the spare material roll.

According to an embodiment of the present disclosure, the material pushing driving component further comprises a guiding contact roller mounted on the driving wheel, the guiding contact roller is rolled and fitted in the chute to roll along the chute.

According to an embodiment of the present disclosure, a peripheral outer surface of the contact end is provided with a tightening groove, the spare material mechanism further comprises a tightening component disposed in the tightening groove;

the tightening component can be controlled to move along a radial direction of the spare material shaft to extend outwardly from the tightening groove or retract to the tightening groove.

According to an embodiment of the present disclosure, the strip connection mechanism comprises a second swing arm, a first clamping component, and a first cutting tool;

one end of the second swing arm is rotatably connected to the mounting frame around a second axis parallel to an axis of the unwinding shaft, the first clamping component is rotatably connected to another end of the second swing arm around a third axis parallel to the second axis, the first clamping component is used to clamp the work material strip, the first cutting tool is disposed on the second swing arm, and can approach or move away from the first clamping component, the first cutting tool is used to cut off the work material strip.

According to an embodiment of the present disclosure, the first clamping component comprises a first turntable, a fixed clamping roller, and a movable clamping roller, the first turntable is rotatably connected to the one end of the second swing arm around the third axis, the fixed clamping roller is mounted on the first turntable, the movable clamping roller can be connected to the first turntable approaching or moving away from the fixed clamping roller.

According to an embodiment of the present disclosure, one of the fixed clamping roller and the movable clamping roller is rotatable around its own axis.

According to an embodiment of the present disclosure, the strip connection mechanism further comprises a first fixing frame, a second sliding block, and a sixth driving member;

the first fixing frame is fixedly connected to the mounting frame, the second sliding block is movably connected to the first fixing frame along a direction parallel to the second axis, one end of the second swing arm away from the first clamping component is rotatably connected to the second sliding block around the second axis, the sixth driving member is mounted on the first fixing frame and is connected with the second sliding block by transmission.

According to an embodiment of the present disclosure, the strip connection mechanism further comprises a first swing shaft and a seventh driving member, the first swing shaft is rotatably connected to the second sliding block around its own axis, one end of the second swing arm away from the first clamping component is fixedly connected to the first swing shaft, the seventh driving member is disposed on the second sliding block and is connected with the first swing shaft by transmission.

According to an embodiment of the present disclosure, the first clamping component further comprises an eighth driving member and a first transmission component, the eighth driving member is fixedly mounted relative to the second sliding block, the first transmission component is connected between the eighth driving member and the first turntable by transmission.

According to an embodiment of the present disclosure, the first transmission component comprises a first transmission shaft, the first transmission shaft is connected with the eighth driving member and the first turntable respectively by transmission.

According to an embodiment of the present disclosure, the first transmission shaft is a hollow shaft, the first transmission shaft is coaxially sleeved outside the first swing shaft and is rotatable relative to the first swing shaft.

According to an embodiment of the present disclosure, the strip connection mechanism comprises:

a moving member, movably connected to the mounting frame approaching or moving away from the spare material roll;

a second clamping component, comprising a second turntable, at least two first clamping rollers, and a clamping plate, the second turntable is rotatably connected to the moving member around a third axis, the clamping plate is disposed on the second turntable, each of the first clamping rollers is disposed on the second turntable; at least one of the at least two first clamping rollers and the clamping plate can approach or move away from another of the at least two first clamping rollers and the clamping plate under an action of external force, so as to form a clamping position for clamping the work material strip between the at least two first clamping rollers and the clamping plate; and a second cutting tool, disposed on the moving member, and can cut into or out of the clamping position between any two adjacent first clamping rollers.

According to an embodiment of the present disclosure, one side of the clamping plate facing the at least two first clamping rollers is provided with a clamping surface, each of the first clamping rollers is disposed at intervals along the clamping surface, and the first clamping rollers are parallel to each other.

According to an embodiment of the present disclosure, the second clamping component comprises two of the first clamping rollers, a cutting channel for the second cutting tool to pass through is defined between the two of the first clamping rollers; the clamping surface is provided with an avoidance slot corresponding to the cutting channel.

According to an embodiment of the present disclosure, each of the first clamping roller is rotatably connected to the second turntable around its own axis.

According to an embodiment of the present disclosure, the moving member is a swing arm, one end of the moving member is rotatably connected to the mounting frame around the second axis, the second turntable is rotatably connected to another end of the moving member around the third axis;

wherein during a process of the moving member rotating around the second axis, the second clamping component can approach or move away from the spare material roll.

According to an embodiment of the present disclosure, the second clamping component further comprises a ninth driving member, the ninth driving member is disposed on the second turntable, and is connected with the clamping plate by transmission; or, the second clamping component further comprises a fourth mounting seat and a ninth driving member, the fourth mounting seat is disposed on the second turntable, each of the first clamping roller is disposed on the fourth mounting seat, the ninth driving member is disposed on the second turntable, and is connected with the fourth mounting seat, so as to drive the fourth mounting seat to approach or move away from the clamping plate.

According to an embodiment of the present disclosure, the second clamping component further comprises a fourth mounting seat and a third elastic member, each of the first clamping rollers is disposed on the fourth mounting seat, the fourth mounting seat is disposed on the second turntable, the third elastic member is disposed between the fourth mounting seat and the clamping plate, so as to provide elastic force making the fourth mounting seat and the clamping plate move in a direction away from each other.

A winding equipment comprises the automatic roll replacing device as described in any of the above-mentioned embodiments.

BRIEF DESCRIPTION OF THE DRAWINGS

In order to more clearly illustrate embodiments of the present application or a technical solution in the prior art, accompanying drawings that need to be used in a description of the embodiments or the prior art will be briefly introduced as follows, obviously, the drawings in the following description are only the embodiments of the present application. For those skilled in the art, other drawings can also be obtained according to the disclosed drawings without creative efforts.

DETAILED DESCRIPTION OF THE PREFERRED EMBODIMENTS

Technical solutions in embodiments of the present application will be clearly and completely described below with reference to the drawings in the embodiments of the present application. Obviously, the described embodiments are only a part of the embodiments of the present application, rather than all the embodiments. Based on the embodiments in the present application, all other embodiments obtained by those of ordinary skill in the art without creative efforts shall fall within a protection scope of the present application.

In addition, terms "first" and "second" are only used for descriptive purposes, and should not be construed as indicating or implying relative importance or implying a number of indicated technical features. Thus, a feature delimited with "first", "second" may expressly or implicitly include at least one of that feature. In the description of the present application, "plurality" means at least two, such as two, three, etc., unless expressly and specifically defined otherwise.

In this application, unless otherwise expressly specified and limited, terms "mounted", "connected", "connected", "fixed" and other terms should be interpreted in a broad sense, for example, it can be a fixed connection, a detachable connection, or an integrated; it can be a mechanical connection or an electrical connection; it can be a direct connection or an indirect connection through an intermediate medium; it may be connection within the two elements or an interaction relationship between the two elements, unless explicitly defined otherwise. For those of ordinary skill in the art, the specific meanings of the above-mentioned terms in this application can be understood according to specific situations.

Figure 1:
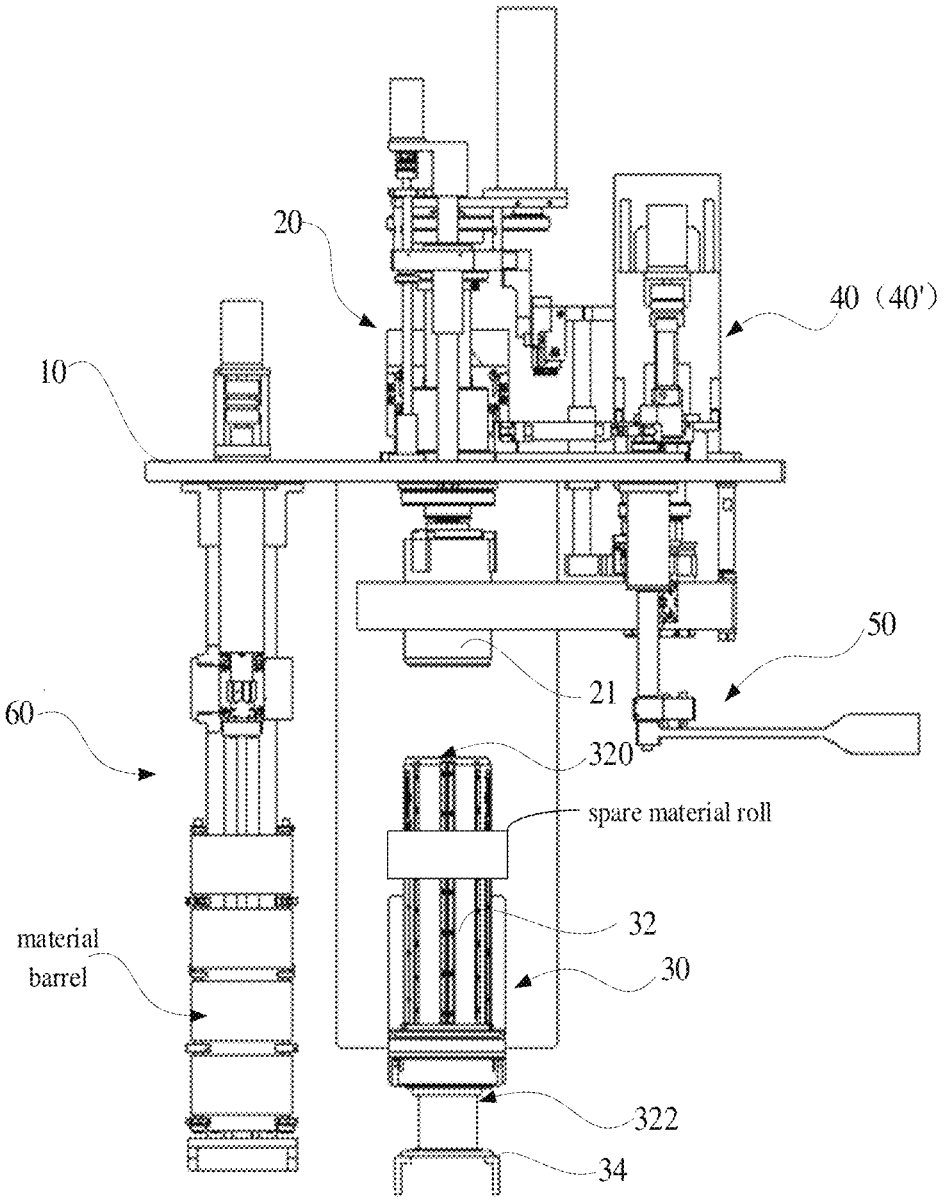
FIG. 1 is a top view of an automatic roll replacing device in an embodiment of the present application.
Figure 2:
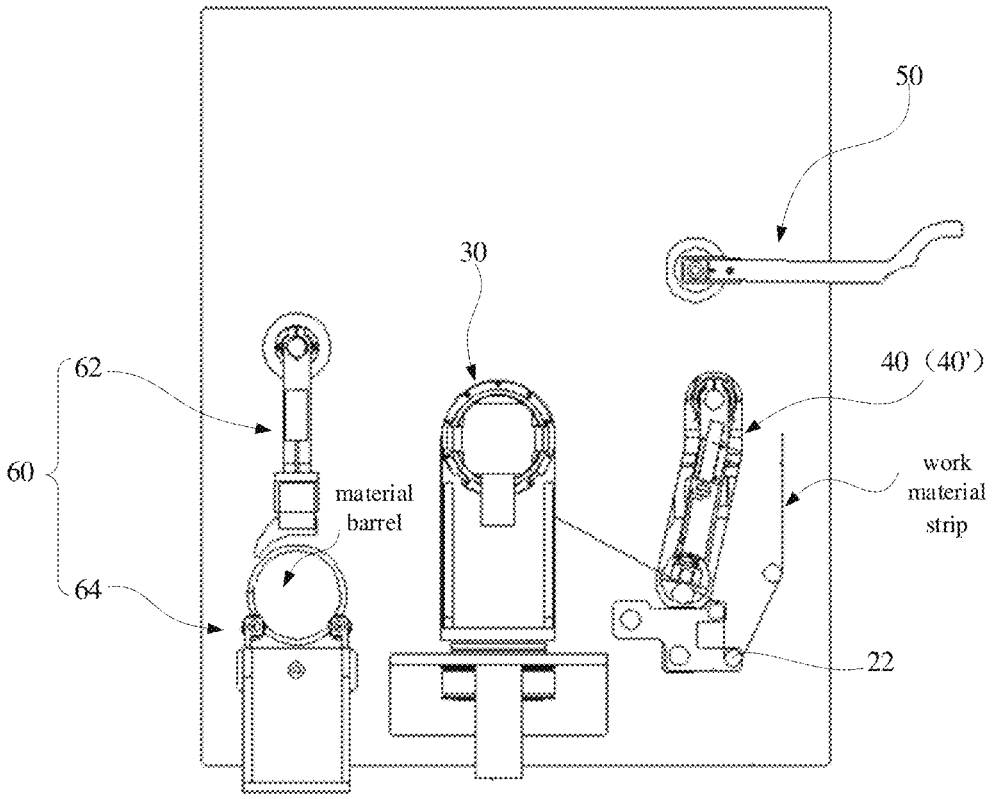
FIG. 2 is a front view of the automatic roll replacing device shown in FIG. 1.
Figure 5:
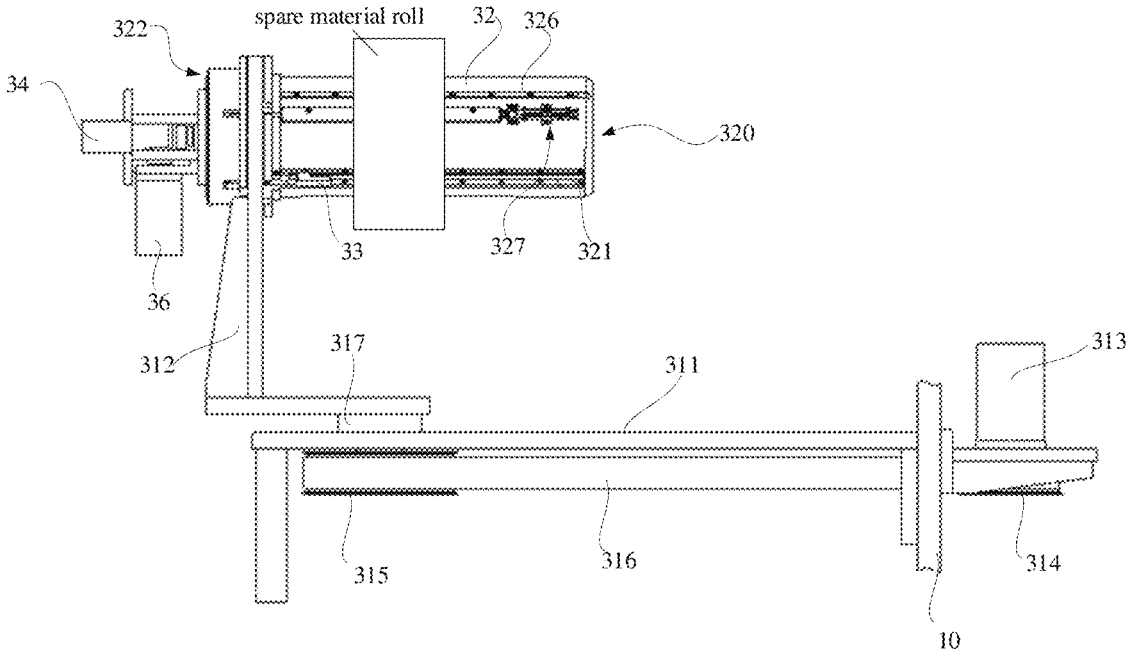
FIG. 5 is a side view of a spare material mechanism shown in FIG. 1.

As shown in FIGS. 1 to 2, an automatic roll replacing device is provided in an embodiment of the present application, which comprises a mounting frame 10, an unwinding mechanism 20, a spare material mechanism 30, and a strip connection mechanism 40. The unwinding mechanism 20 comprises an unwinding shaft 21 rotatably connected to the mounting frame 10 around its own axis. The spare material mechanism 30 comprises a spare material shaft 32 and a material pushing member 33 (as seen in FIG. 5). The spare material shaft 32 is provided with a contact end 320. The spare material shaft 32 is rotatably connected to the mounting frame 10 around a rotation axis. The material pushing member 33 is used to provide axial pushing force for a spare material roll on the spare material shaft 32. A material pushing position is provided during a process of the spare material shaft 32 rotating around the rotation axis. When the spare material shaft 32 is located at the material pushing position, the contact end 320 of the spare material shaft 32 is mated with the unwinding shaft 21, the material pushing member 33 is controlled to push the spare material roll on the spare material shaft 32 to transfer to the unwinding shaft 21. It can be understood that since the spare material shaft 32 is to be rotated to the material pushing position, the above-mentioned rotation axis and an axis of the spare material shaft 32 are not parallel to each other. Preferably, the rotation axis is perpendicular to the axis of the spare material shaft 32.

The strip connection mechanism 40 is disposed on the mounting frame 10, which is used to cut off a work material strip unwound from the unwinding shaft 21, and to connect a cut-off work material strip to the spare material roll on the unwinding shaft 21.

The above-mentioned automatic roll replacing device, when work material rolls on the unwinding shaft 21 are used up and when the automatic roll replacing device is required to replace new material rolls, firstly the strip connection mechanism 40 is used to cut off the work material strip unwound from the unwinding shaft 21, and to release a material barrel from the unwinding shaft 21 (the material roll includes a material barrel and a material strip wound on the material barrel). Then the spare material shaft 32 rotates around the rotation axis, so that the contact end 320 of the spare material shaft 32 is mated with the unwinding shaft 21; and then the material pushing member 33 pushes the spare material roll on the spare material shaft 32 to transfer to the unwinding shaft 21. Finally, the strip connection mechanism 40 is used to connect a cut-off work material strip to the spare material roll on the unwinding shaft 21, so as to realize automatic roll replacing. This way, compared with the automatic roll replacing device in the prior art, which needs to be equipped with two sets of unwinding mechanisms on standby for each other, the automatic roll replacing device of the present application utilizes the spare material shaft 32 and the material pushing member 33 to push the spare material roll on the spare material shaft 32 to the unwinding shaft 21, and does not need to be equipped with two sets of unwinding mechanisms 20, thereby greatly simplifying a structure of the automatic roll replacing device, and reducing occupied space.

What needs to be said is, it should be understood that the material pushing member 33 provides axial pushing force for the spare material roll on the spare material shaft as follows: the pushing force provided by the material pushing member 33 may be that: the pushing force itself is parallel to an axial direction of the spare material shaft 32, or it may be component force parallel to the axial direction of the spare material shaft 32, as long as the spare material roll on the spare material shaft 32 can be pushed to the unwinding shaft 21, it is not limited here.

In an embodiment of the present application, the unwinding shaft 21 is movable relative to the mounting frame 10 along its own axial direction. This way, position correction (i.e., adjusting a position of the material strip in its width direction) can be realized by moving the unwinding shaft 21 along its own axial direction.

Figure 3:
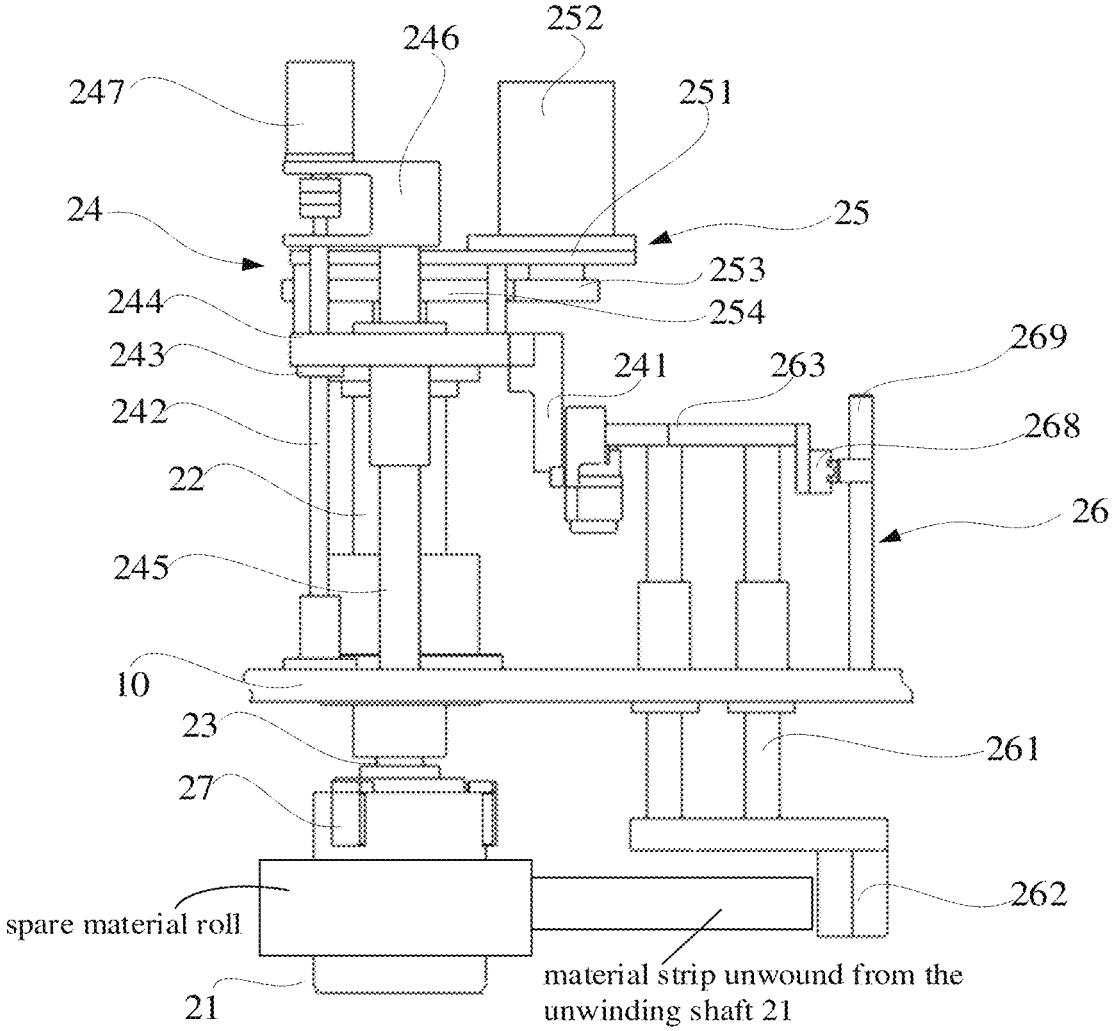
FIG. 3 is a top view of an unwinding mechanism of the automatic roll replacing device shown in FIG. 1.
Figure 4:
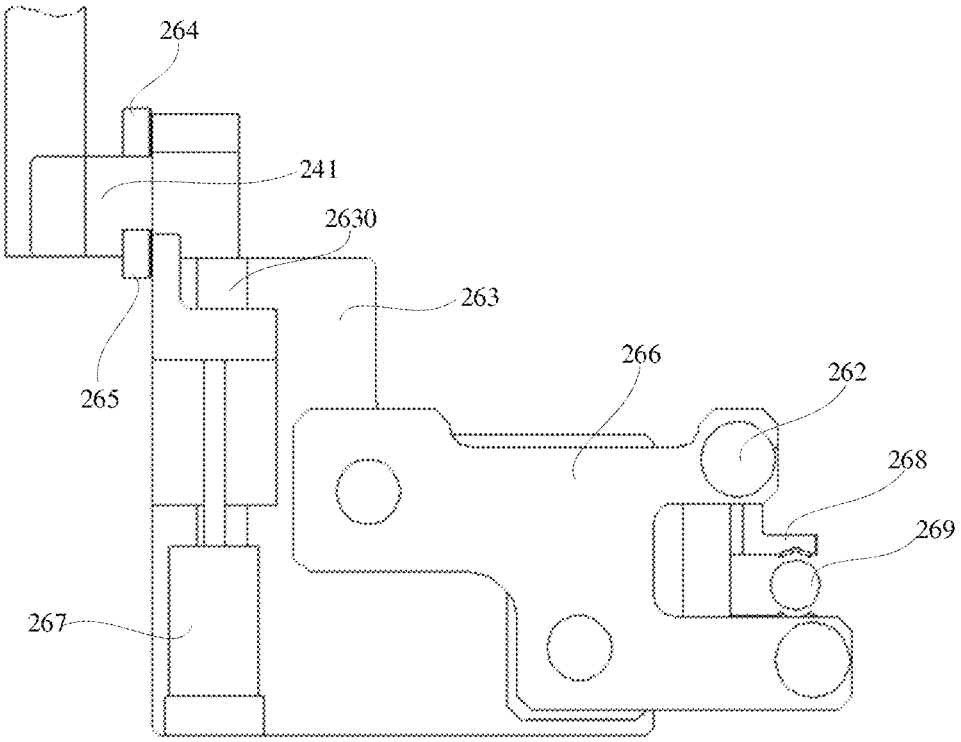
FIG. 4 is a front view of the unwinding mechanism shown in FIG. 3 (with some hidden parts).

Please refer to FIG. 3 and FIG. 4 together, in an embodiment of the present application, the unwinding mechanism 20 further includes a first guiding post 22, a rotating shaft 23, a first driving component 24, and a second driving component 25. The first guiding post 22 is movably connected to the mounting frame 10 along its own axis. The rotating shaft 23 is fixed in an axial direction and is rotatably fitted to the first guiding post 22 in a circumferential direction. That is, the first guiding post 22 is a hollow post, the rotating shaft 23 is sleeved in the first guiding post 22, the rotating shaft 23 can rotate relative to the first guiding post 22 around its own axis, and is fixed relative to the first guiding post 22 in the axial direction of the rotating shaft 23. The unwinding shaft 21 is fixedly connected to one end of the rotating shaft 23, so that the unwinding shaft 21 rotates synchronously with the rotating shaft 23, thereby realizing unwinding. The first driving component 24 is disposed on the mounting frame 10, and is connected with the first guiding post 22 by transmission, making the first driving component 24 drive the first guiding post 22 to move relative to the mounting frame 10 along its own axial direction, so that the unwinding shaft 21 is driven to move along its own axis. The second driving component 25 is disposed on the first guiding post 22, and is connected with the rotating shaft 23 by transmission, making the second driving component 25 drive the rotating shaft 23 to rotate around its own axis, so that the unwinding shaft 21 is driven to rotate. This way, the unwinding shaft 21 is driven to move along its own axis and to rotate around its own axis through the first driving component 24 and the second driving component 25 respectively, with simple structure and stable operation. In addition, the rotating shaft 23 sleeved in the first guiding post 22 is beneficial to reduce a volume of the structure and the occupied space. Preferably, the first guiding post 22, the rotating shaft 23, and the unwinding shaft 21 are arranged coaxially.

Specifically, in the embodiment, the rotating shaft 23 can be installed in the first guiding post 22 through a bearing, so that the rotating shaft 23 is rotatable relative to the first guiding post 22 and fixed relative to the first guiding post 22 in the axial direction.

In some embodiments, the unwinding mechanism 20 further comprises a conveying roller component 26. The conveying roller component 26 comprises a second guiding post 261 and a conveying roller 262. The second guiding post 261 is movably connected to the mounting frame 10 along a direction parallel to the first guiding post 22, and the second guiding post 261 and the first guiding post 22 are controllably connected to or separated from each other. The conveying roller 262 is mounted on the second guiding post 261, which is used to guide a work material strip unwound from the unwinding shaft 21. This way, when the work material strip needs position correction, the second guiding post 261 is controlled to be connected with the first guiding post 22, so that the second guiding post 261 and the first guiding post 22 move synchronously, so the unwinding shaft 21 and the conveying roller 262 can be moved synchronously in a direction parallel to an axis of the unwinding shaft 21, and a position in a width direction of the material strip can be adjusted (i.e., position correction), which avoids an relative movement of the work material strip and the conveying roller 262 in the axial direction of the unwinding shaft 21 during a position correction process from being worn on the work material strip, which is beneficial to improve product quality. When the position correction is not required, the second guiding post 261 is controlled to separate from the first guiding post 22, thereby preventing the first guiding post 22 from moving along its own axis (for example, during replacing roll and unloading material) to drive the second guiding post 261 and the conveying roller 262 to move.

Specifically, the first guiding post 22 is fixedly connected to a driving portion 241. The second guiding post 261 is fixedly connected to a mounting member 263. The conveying roller component 26 further comprises a fixing holding member 264 and a movable holding member 265. The fixing holding member 264 is mounted on the mounting member 263, and abuts against one side of the driving portion 241. The movable holding member 265 is movably connected to the mounting member 263. The movable holding member 265 can abut against another side of the driving portion 241 during a moving process, so that the driving portion 241 is gripped by the fixing holding member 264 and the movable holding member 265, that is, connection between the second guiding post 261 and the first guiding post 22 is realized. When it is necessary to separate the second guiding post 261 from the first guiding post 22, the movable holding member 265 can be moved so that the movable holding member 265 and the fixing holding member 264 are released and separated from the driving portion 241. Optionally, the second guiding posts 261 may include two or more parallel to each other; this way, on one hand, moving stability of the conveying roller 262 is improved, and shaking of the conveying roller 262 is reduced; on another hand, it can prevent rotation of the second guiding post 261.

Furthermore, the conveying roller component 26 further includes a conveying roller mounting plate 266, the conveying roller mounting plate 266 is fixedly connected to the second guiding post 261, and the conveying roller 262 is mounted on the conveying roller mounting plate 266.

Specifically, in an embodiment, the conveying roller component 26 further includes a first sliding rail 2630 and a first driving member 267. The first sliding rail 2630 is fixedly connected to the mounting member 263. The movable holding member 265 is disposed on the first sliding rail 2630, and can slide along the first sliding rail 2630. The first driving member 267 is fixedly connected to the mounting member 263, and is connected with the movable holding member 265 by transmission to drive the movable holding member 265 to move along the first sliding rail 2630. This way, the first sliding rail 2630 and the first driving member 267 are used to realize movement of the movable holding member 265, so that gripping and loosening actions are stable and reliable. Optionally, the first driving member 267 may be a cylinder. It can be understood that the first driving member 267 can also be other driving members capable of realizing linear reciprocating motion, which is not limited here.

Furthermore, the fixing holding member 264 and the movable holding member 265 are respectively located on both sides of the driving portion 241 in a direction perpendicular to the first guiding post 22, so that movement of the first guiding post 22 along its own axis is prevented from being interfered with when the fixing holding member 264 and the movable holding member 265 release the driving portion 241.

Furthermore, one side of the driving portion 241 facing the movable holding member 265 has a matching groove which can be matched with the movable holding member 265. This way, stability when the movable holding member 265 and the fixing holding member 264 grip the driving portion 241 is further improved. Optionally, both the fixing holding member 264 and the movable holding member 265 can be rollers. When the fixing holding member 264 and the movable holding member 265 are released, the fixing holding member 264 can roll on a surface of the driving portion 241, reducing friction.

In some embodiments, the conveying roller component 26 further includes a locking member 268 and a locking lever 269. The locking member 268 is fixedly connected to the mounting member 263, the locking lever 269 is fixedly connected to the mounting frame 10. The locking lever 269 is parallel to the second guiding post 261, the locking member 268 is controllably connected to or separated from the locking lever 269. This way, when a position correction is not required, the second guiding post 261 is separated from the first guiding post 22. At this time, in order to prevent movement of the conveying roller 262, the locking member 268 can be connected to the locking lever 269. When a position correction is required, the locking member 268 is separated from the locking lever 269, the second guiding post 261 is connected to the first guiding post 22, therefore, the second guiding post 261 and the first guiding post 22 can move synchronously along an axial direction of the first guiding post 22; that is, the conveying roller 262 and the unwinding shaft 21 can move synchronously along the axial direction of the unwinding shaft 21, thereby realizing the position correction. Optionally, the locking member 268 may be a gripper cylinder.

In some embodiments, the first driving component 24 includes a first lead screw 242, a first lead screw nut 243, and a sliding member 244. One end of the first lead screw 242 can be rotatably connected to the mounting frame 10 around its own axis, and is parallel to the first guiding post 22. The first lead screw nut 243 is threadedly connected to the first lead screw 242. The sliding member 244 is fixedly connected to the first guiding post 22 and the first lead screw nut 243. This way, rotation of the first lead screw 242 drives the first lead screw nut 243 to move along the first lead screw 242, thereby driving the sliding member 244 and the first guiding post 22 to move along an axial direction of the first guiding post 22, so that the unwinding shaft 21 is driven to move along its own axis. Furthermore, the driving portion 241 is fixedly connected to the sliding member 244.

Specifically, in the embodiment, the first driving component 24 further includes a third guiding post 245, a first mounting seat 246, and a lead screw driving member 247. One end of the third guiding post 245 is fixedly connected to the mounting frame 10, and is parallel to the first guiding post 22. The first mounting seat 246 is fixedly connected to another end of the third guiding post 245. The lead screw driving member 247 is mounted on the first mounting seat 246, and is connected with one end of the first lead screw 242 away from the mounting frame 10 by transmission, so that the lead screw driving member 247 drives the first lead screw 242 to rotate around its own axis. Furthermore, the sliding member 244 is disposed on the third guiding post 245, and can move along the third guiding post 245, so as to guide the sliding member 244, making movement of the sliding member more stable. Specifically, the lead screw driving member 247 can be a motor.

Optionally, an outputting shaft of the lead screw driving member 247 may be connected with the first lead screw 242 by transmission through a shaft coupling.

In order to make movement of each sliding parts more stable, optionally, the sliding member 244 may be slidably mounted on the third guiding post 245 through a guiding sleeve. The first guiding post 22 can also be slidably mounted on the mounting frame 10 through a guiding sleeve. The second guiding post 261 can also be slidably mounted on the mounting frame 10 through a guiding sleeve.

In some embodiments, the second driving component 25 includes a second mounting seat 251, a rotating driving member 252, and a transmission structure. The second mounting seat 251 is fixedly connected to the first guiding post 22. The rotating driving member 252 is mounted on the second mounting seat 251. The transmission structure is connected between the rotating driving member 252 and the rotating shaft 23 by transmission, so as to make the rotating driving member 252 drive the rotating shaft 23 to rotate around its own axis, so that the unwinding shaft 21 is driven to rotate around its own axis. Specifically, in the embodiment, the second mounting seat 251 is fixedly connected to the sliding member 244.

Specifically, in the embodiment, the transmission structure includes a driving gear 253 and a driven gear 254 that mesh with each other. The driving gear 253 is mounted on an outputting shaft of the rotating driving member 252, so as to make the driving gear 253 and the outputting shaft of the rotating driving member 252 rotate synchronously. The driven gear 254 is mounted on the rotating shaft 23, so as to make the driven gear 254 and the rotating shaft 23 rotate synchronously. Rotational motion output by the rotating driving member 252 is transferred to the rotating shaft 23 through the driving gear 253 and the driven gear 254 that mesh with each other, thereby driving the rotating shaft 23 to rotate. It should be noted that the transmission structure is not limited to adopting a gear transmission structure, but also a structure such as a strip transmission, which is not limited here. Optionally, the rotating driving member may be a motor.

It should be noted that the unwinding shaft 21 and the conveying roller 262 are mounted on a same side of the mounting frame 10, so as to guide the material strip unwound from the unwinding shaft through the conveying roller 262. The first guiding post 22 and the second guiding post 261 penetrate through opposite sides of the mounting frame 10, and the third guiding post 245 is located on one side of the mounting frame 10 away from the unwinding shaft 21.

In an embodiment of the present application, the spare material mechanism 30 further includes a pushing block 34 (as seen in FIG. 1). The spare material shaft 32 is further provided with a pushing end 322 opposite to the contact end 320. The pushing block 34 is fixedly connected to the pushing end 322. A spare material position is further provided during a process of the spare material shaft 32 rotating around the rotation axis. When the spare material shaft 32 is located at the spare material position, the pushing block 34 faces the unwinding shaft 21, so as to push the spare material roll on the unwinding shaft 21. This way, after the material pushing member 33 pushes the spare material roll on the spare material shaft 32 to the unwinding shaft 21, the unwinding shaft 21 moves along its axis in a direction away from the spare material shaft 32, and the spare material shaft 32 rotates around the rotation axis to the spare material position, so as to make the pushing block 34 face the unwinding shaft 21. Then the unwinding shaft 21 moves along its axis in a direction close to the spare material shaft 32, and the pushing block 34 abuts against the spare material roll on the unwinding shaft 21, so that the spare material roll and the unwinding shaft 21 move relatively along the axis of the unwinding shaft 21, so as to adjust a position of the spare material roll on the unwinding shaft 21 (i.e., positioning). Optionally, the pushing block 34 includes a housing fixedly connected to the pushing end 322 and a plurality of pushing claws disposed around the housing. Each of the pushing claws extends to one side of the housing facing away from the pushing end 322, and is used to contact the spare material roll on the unwinding shaft 21 to push the spare material roll. This way, a contact between the unwinding shaft 21 and the pushing block 34 is avoided.

It should be noted that in order to prevent the unwinding shaft 21 and the spare material roll on the unwinding shaft 21 from interfering with movement of the pushing block 34 in a process of the spare material shaft 32 rotating around the rotation axis to the spare material position, therefore, before the spare material shaft 32 is rotated to the spare material position, the unwinding shaft 21 needs to move along its own axis in a direction away from the spare material shaft 32, so as to effectively make way for the spare material shaft 32. When the spare material shaft 32 is rotated to the spare material position, the unwinding shaft 21 moves along its own axis in a direction close to the spare material shaft 32; and at a same time, the pushing block is used to push the spare material roll on the unwinding shaft 21, so that positioning of the spare material roll on the unwinding shaft 21 is realized.

Specifically, in the embodiment, a positioning block 27 is provided on the unwinding shaft 21. This way, the pushing block 34 pushes the spare material roll on the unwinding shaft 21 until it abuts against the positioning block 27 to achieve positioning, that is, the spare material roll is pushed to a position.

Figure 8:
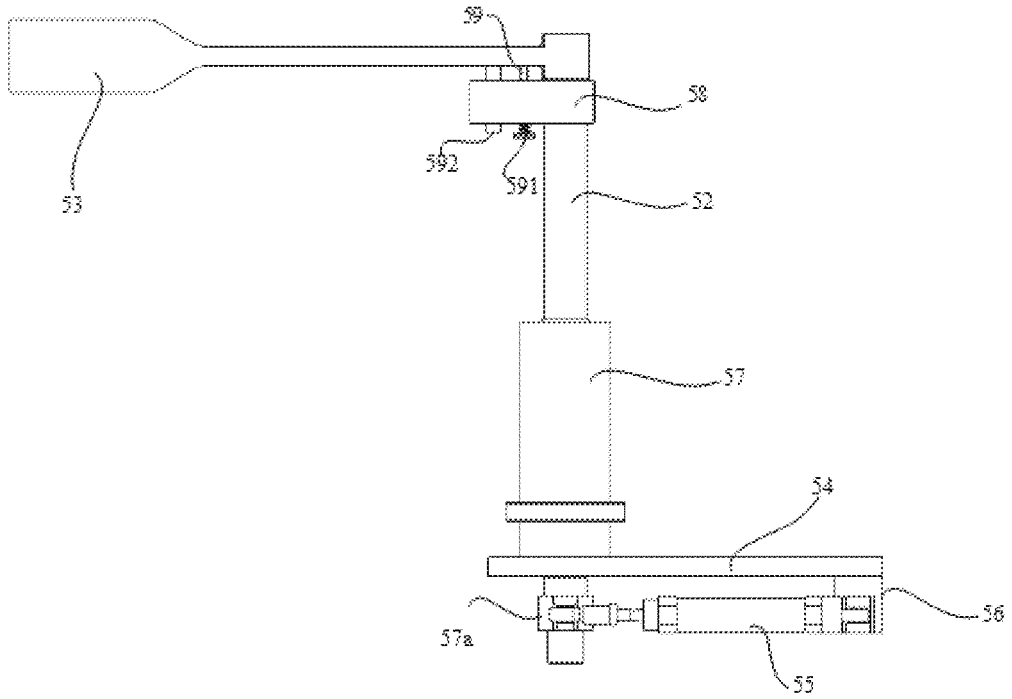
FIG. 8 is a schematic structural view of a pushing mechanism of the automatic roll replacing device shown in FIG. 1.

It should be noted that the positioning of the spare material roll on the unwinding shaft 21 is not limited to the method of installing a pushing member on the spare material shaft 32; in other embodiments, an independent pushing mechanism 50 can also be designed. Please refer to FIG. 8, the pushing mechanism 50 includes a pushing shaft 52 and a pushing member 53, the pushing shaft 52 is rotatably connected to the mounting frame 10 around its own axis. The pushing member 53 is mounted on the pushing shaft 52. A pushing position is provided during a process of the pushing shaft 52 rotating around its own axis. When the pushing member 53 is located at the pushing position, the pushing member 53 is located between the unwinding shaft 21 and the spare material shaft 32, which is used to push the spare material roll on the unwinding shaft 21.

This way, when the spare material roll on the spare material shaft 32 is pushed to the unwinding shaft 21 through the material pushing member 33, the unwinding shaft 21 moves along its own axis in a direction away from the spare material shaft 32, the pushing shaft 52 of the pushing mechanism rotates to drive the pushing member 53 to located at the pushing position; at this time, the pushing member 53 is located between the unwinding shaft 21 and the spare material shaft 32. Then, the unwinding shaft 21 moves along its own axis to one end close to the spare material shaft 32, so that the pushing member 53 abuts against the spare material roll on the unwinding shaft 21, and then pushes the spare material roll to the position. Finally, the pushing shaft 52 drives the pushing member 53 to rotate to locate at an initial position, the unwinding shaft 21 moves along its own axis to a work position.

Specifically, in the embodiment, the pushing mechanism includes a third mounting seat 54 and a pushing driving member 55. The third mounting seat 54 is fixedly mounted on the mounting frame 10. The pushing shaft 52 is rotatably connected to the third mounting seat 54 around its own axis. The pushing driving member 55 is disposed on the third mounting seat 54, and is connected with the pushing shaft 52 by transmission, so as to drive the pushing shaft 52 to rotate around its own axis.

Furthermore, the pushing driving member 55 can be a cylinder. The pushing mechanism further includes a driving block 57*a* and a hinged seat 56. The driving block 57*a* is fixedly connected to the pushing shaft 52, the hinged seat 56 is fixedly connected to the third mounting seat 54. A fixing end of the pushing driving member 55 is hingedly connected to the hinged seat 56, and a hinged axis is parallel to an axis of the pushing shaft 52. A driving end of the pushing driving member 55 is hingedly connected to the driving block 57*a*, and a hinged axis is parallel to the axis of the pushing shaft 52 and not collinear. This way, the pushing shaft 52 is driven to rotate around its own axis by extension and retraction of the driving end of the pushing driving member 55, thereby driving the pushing member 53 to swing.

Furthermore, the pushing mechanism further includes a rotating supporting base 57, the rotating supporting base 57 is fixedly connected to the third mounting seat 54. The pushing shaft 52 penetrates through the rotating supporting base 57, and can rotate relative to the rotating seat 57. Specifically, the pushing shaft 52 is mounted on the rotating supporting seat 57 through a bearing.

Specifically, in the embodiment, the pushing mechanism further includes an adjusting block 58, an adjusting lever 59, and a first elastic member 591. The adjusting block 58 is fixedly connected to the pushing shaft 52, the pushing member 53 can be movably mounted on one end of the pushing shaft 52 along an axis of the pushing shaft 52. One end of the adjusting lever 59 penetrates through the adjusting block 58, and is connected to the pushing member 53. The first elastic member 591 is disposed on one side of the adjusting block 58 away from the pushing member 53; and one end of the first elastic member 591 abuts against the adjusting lever 59, another end of the first elastic member 591 abuts against the adjusting block 58, so as to provide preload force that makes the pushing member 53 have a tendency to move toward the adjusting block 58 along the axis of the pushing shaft 52. Optionally, the first elastic member 591 can be a compression spring. The compression spring is sleeved on the adjusting lever 59, and is located at one side of the adjusting block 58 away from the pushing member 53. Optionally, the adjusting lever 59 is a screw rod, and the screw is threadedly connected to the pushing member 53.

This way, when the pushing member 53 is located at the pushing position (that is located between the unwinding shaft 21 and the spare material shaft 32), the unwinding shaft 21 moves toward the spare material shaft 32 along its own axis, the spare material roll on the unwinding shaft 21 contacts with the pushing member 53, so that the first elastic member 591 is compressed for buffering, and the pushing member 53 abuts against the spare material shaft 32 for supporting. When the unwinding shaft 21 is going on to move toward the spare material shaft 32 along its own axis, the pushing member 53 pushes the spare material roll on the unwinding shaft 21 to move relative to the unwinding shaft 21, making it be located at the work position.

Furthermore, the pushing mechanism further includes a guiding lever 592. The guiding lever 592 penetrates through the adjusting block 58, and is movable relative to the adjusting block 58, and one end of the guiding lever 592 is fixedly connected to the pushing member 53. This way, the guiding lever 592 can guide the pushing member 53 to slide along the axis of the pushing shaft 52. It can be understood that the guiding lever 592 is parallel to the pushing shaft 52.

Figure 6:
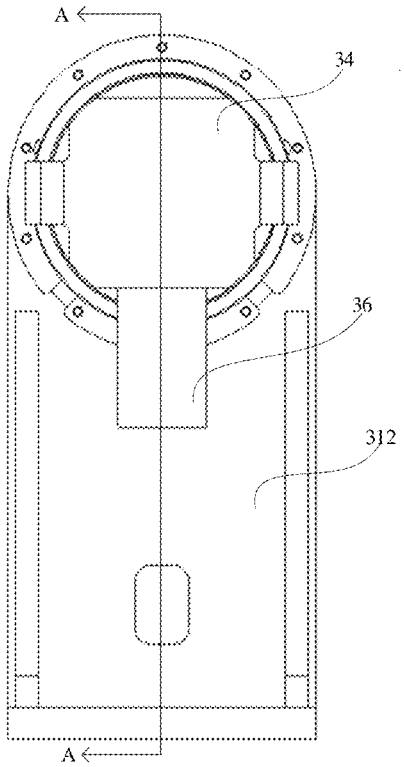
FIG. 6 is a front view of the spare material mechanism shown in FIG. 5.
Figure 7:
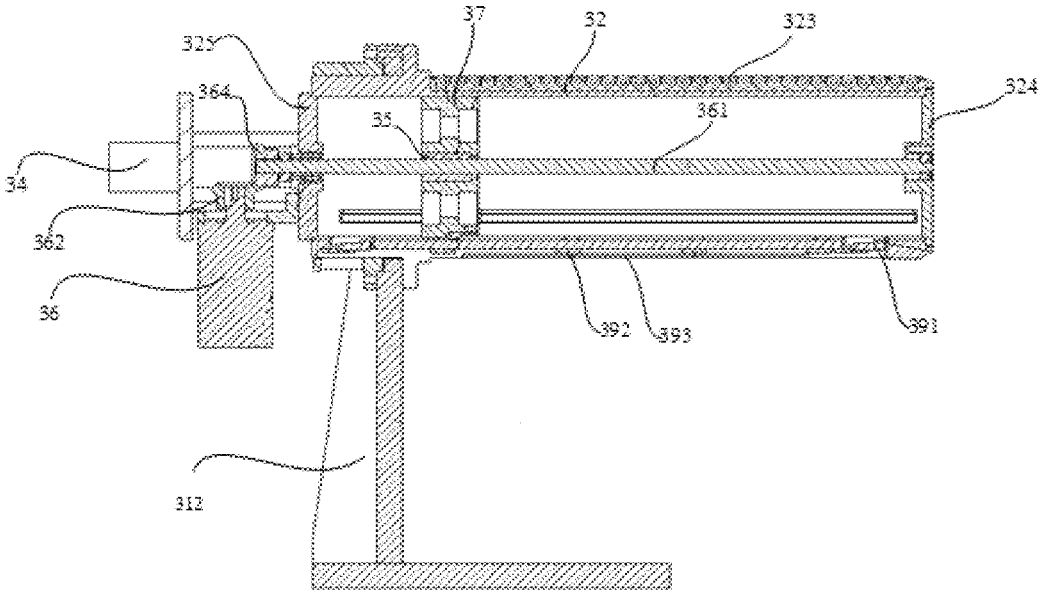
FIG. 7 is a cross-sectional view taken along a line A-A shown in FIG. 6.

Please refer to FIG. 5, FIG. 6 and FIG. 7 together, in an embodiment of the present application, the spare material shaft 32 is a hollow shaft. At least one chute 321 is defined on a circumferential side wall of the spare material shaft 32. The chute 321 extends longitudinally along an axial direction of the spare material shaft 32. The material pushing member 33 is slidably disposed in the spare material shaft 32 along the axial direction of the spare material shaft 32, and extends out of the axial direction of the spare material shaft 32 from the corresponding chute 321. This way, the spare material roll is sleeved on the spare material shaft 32, when the material pushing member 33 slides along the chute 321, an extending portion of the material pushing member 33 pushes the spare material roll to move along the spare material shaft 32, until the spare material shaft 32 is pushed to the unwinding shaft 21.

In some embodiments, the spare material mechanism 30 further includes a material pushing driving component, the material pushing driving component includes a material pushing lead screw 361, a material pushing lead screw nut 35, and a material pushing driving member 36. The material pushing lead screw 361 is disposed in the spare material shaft 32, and can be movable relative to the spare material shaft 32. The material pushing lead screw nut 35 is threadedly connected to the material pushing lead screw 361. The material pushing member 33 is relatively fixed to the material pushing lead screw nut 35. The material pushing driving member 36 is mounted on one end of the spare material shaft 32, and is connected with the material pushing lead screw 361 by transmission to drive the material pushing lead screw 361 to rotate. This way, when it is necessary to push the spare material roll on the spare material shaft 32 to the unwinding shaft 21, the material pushing driving member 36 drives the material pushing lead screw 361 to rotate, so as to drive the material pushing lead screw nut 35 to move along the material pushing lead screw 361, so as to drive the material pushing member 33 to move along the material pushing lead screw 361 (that is, move along the axial direction of the spare material shaft 32). It can be understood that the material pushing lead screw 361 is parallel to the axial direction of the spare material shaft 32. Preferably, the material pushing lead screw 361 is coaxially disposed in the spare material shaft 32.

Specifically, in the embodiment, the material pushing driving component further includes a driving bevel gear 362 and a driven bevel gear 364 that mesh with each other. The driving bevel gear 362 is mounted on an outputting shaft of the material pushing driving member 36, the driven bevel gear 364 is mounted on one end of the material pushing lead screw 361. This way, a transmission between the material pushing driving member 36 and the material pushing lead screw 361 is realized through the driving bevel gear 362 and the driven bevel gear 364 that mesh with each other. Optionally, the material pushing driving member 36 can be a motor.

Specifically, in the embodiment, the material pushing driving component further includes a driving wheel 37 that is fixedly sleeved outside of the material pushing lead screw nut 35. The material pushing member 33 is fixedly connected to the driving wheel 37.

In order to guide the driving wheel 37, in one embodiment, the material pushing driving component further includes a material pushing guiding lever fixedly installed in the spare material shaft 32; the material pushing guiding lever is parallel to the axis of the spare material shaft 32, and penetrates through the driving wheel 37, the driving wheel 37 can slide along the material pushing guiding lever. This way, the material pushing guiding lever is used to guide movement of the driving wheel 37, making movement of the material pushing member more stable, making a pushing action stable and reliable. It should be noted that in another embodiment, the material pushing guiding lever may not be provided, but movement of the driving wheel 37 is guided by an inner wall of the spare material shaft 32. That is, the driving wheel 37 is slidably matched with the circumferential inner wall of the spare material shaft 32, so that the driving wheel 37 can slide along the circumferential inner wall of the spare material shaft 32, so as to guide the movement of the driving member 37.

Specifically, in the embodiment, the material pushing driving component further includes a guiding contact roller mounted on the driving wheel 37; the guiding contact roller is rolled and fitted in the chute 321 to roll along the chute 321, thereby guiding axial movement of the driving wheel 37 and the material pushing member 33 along the spare material shaft 32, so that a material pushing of the material pushing member 33 is more stable. Since the guiding contact roller is provided for guidance, the material pushing member 33 can only penetrate through the chute 321 to outside of the spare material shaft 32 without contacting the inner wall of the chute 321 for guidance, thereby avoiding being worn due to contacting between the material pushing member 33 and the inner wall of the chute 321.

More specifically, the spare material shaft 32 is provided with two chutes 321, and each of the chutes 321 is provided with one material pushing member 33 correspondingly. This way, the two material pushing members 33 are arranged to move along the two chutes 321 respectively, so that the material pushing of the material pushing members 33 is more stable. Two chutes 321 are located at a bottom of the spare material shaft 32.

Specifically, in the embodiment, the spare material mechanism 30 further includes a first sensor 391. A detection port is arranged on a peripheral side of the spare material shaft 32. The first sensor 391 is mounted on the detection port for detecting a position of the driving wheel 37. This way, the first sensor 391 can detect the position of the driving wheel 37 to limit a movement range of the driving wheel 37 to prevent the driving wheel 37 from colliding with components at both ends of the spare material shaft 32. It can be understood that the driving wheel 37 is provided with a sensing block corresponding to the first sensor 391.

Specifically, in the embodiment, the spare material shaft 32 has at least one spare material position along its axial direction for being sleeved by the spare material roll. Each of the spare material position is provided with a second sensor 392. The second sensor is used to detect whether the corresponding spare material position is sleeved with a spare material roll. This way, through the second sensor 392, it can be detected whether each of the spare material position on the spare material 32 has a spare material roll.

Preferably, the first sensors 391 include two, and the detection ports also include two. The two detection ports are arranged at intervals along the axial direction of the spare material shaft 32, and the two first sensors 391 are respectively installed in the two detection ports. In order to prevent the second sensor 392 from affecting the spare material shaft 32 to load the spare material roll, a detection groove may be provided on a circumference of the spare material shaft 32, and the detection groove is connected with the two detection ports. A plurality of second sensors 392 are disposed in the detection groove. Furthermore, the spare material mechanism 30 further includes a covering plate 393, and the covering plate 393 covers the detection groove to prevent the second sensor 392 from falling off. The covering plate 393 has a detection notch corresponding to a position of the second sensor 392. The second sensor 392 detects the spare material roll through the corresponding detection notch.

Specifically, in the embodiment, the spare material mechanism further includes a plurality of guiding wheels 323. A peripheral surface of the spare material shaft 32 is provided with a guiding groove extending longitudinally along the axial direction of the spare material shaft 32. Each of the guiding wheels 323 partially protrudes from the peripheral side surface of the spare material shaft 32. This way, the guiding wheel 323 guides movement of the spare material roll along the axial direction of the spare material shaft 32, so that the movement of the spare material roll is more stable. Optionally, the guiding groove is arranged on a top of the spare material shaft 32.

Specifically, in the embodiment, a wear-resistant strip 326 is provided on the circumferential side wall of the spare material shaft 32. The wear-resistant strip 326 extends longitudinally along the axial direction of the spare material shaft 32. The wear-resistant strip 326 is used to prevent the spare material shaft 32 from being worn when the spare material roll moves frequently on the spare material shaft 32. Furthermore, a mounting groove for installing the wear-resistant strip 326 is provided on the circumferential side wall of the spare material shaft 32. The wear-resistant strip 326 partially protrudes from the peripheral side surface of the spare material shaft 32.

Specifically, in the embodiment, a tightening groove is provided on a peripheral outer surface of the contact end 320 of the spare material shaft 32; and the spare material mechanism further includes a tightening component 327 disposed in the tightening groove. The tightening component 327 can be controlled to move along a radial direction of the spare material shaft 32 to extend outwardly from the tightening groove or retract to the tightening groove. When the tightening component 327 moves along the radial direction of the spare material shaft 32 and extends out of the tightening groove, the tightening component 327 is tightened and sleeved on the spare material roll on the contact end 320; and the spare material roll is fixed relative to the spare material shaft 32 at this time, that is, the spare material roll cannot move along the axial direction of the spare material shaft 32, which prevents the spare material roll from being thrown out under an action of centrifugal force during rotation of the spare material shaft 32. When the tightening component 327 moves along the radial direction of the spare material shaft 32 to retract to the tightening groove, a tightening of the tightening component 327 to the spare material roll sleeved on the contact end 320 is released; and the spare material roll can move along the axial direction of the spare material shaft 32 to facilitate roll replacing.

Furthermore, the tightening component 327 includes a tightening block and an expansion member. The tightening block is disposed in the tightening groove of the spare material shaft 32, and the tightening block can move along the radial direction of the spare material shaft 32 to extend outwardly from the tightening groove or retract to the tightening groove. The expansion member is disposed between a bottom wall of the tightening groove and the tightening block. The expansion member can be controlled to expand or contract, so as to drive the tightening block to move in the radial direction of the spare material shaft 32. Optionally, the expansion member may be an airbag. When the spare material roll needs to be fixed, inflating the airbag can make the tightening block move outwardly along the radial direction of the spare material shaft 32, and the tightening block extends out of the tightening groove, thereby fixing the spare material roll relative to the spare material shaft 32. When there is no need to fix the spare material roll, deflate the airbag, so that the tightening block moves inwardly along the radial direction of the spare material shaft 32, and the tightening block retracts to the tightening groove, thereby loosening the spare material roll.

Specifically, in the embodiment, the spare material mechanism 30 further includes a first end cap 324 fixedly connected to the contact end 320 of the spare material shaft 32 and a second end cap 325 fixedly connected to the pushing end 322 respectively. Two opposite ends of the material pushing lead screw 361 are respectively rotatably connected to the first end cap 324 and the second end cap 325 through bearings.

Specifically, in the embodiment, the spare material mechanism 30 further includes a mounting bracket 311, a rotating bracket 312, a spare-material driving member 313, and a spare-material transmission component. The mounting bracket 311 is fixedly mounted on the mounting frame 10, the rotating bracket 312 is rotatably connected to the mounting bracket 311 around the rotation axis. The pushing end 322 of the spare material shaft 32 is fixedly connected to the rotating bracket 312. The spare-material driving member 313 is disposed on the mounting frame 10, the spare-material transmission component is connected between the spare-material driving member 313 and the rotating bracket 312 by transmission, making the spare-material driving member 313 drive the rotating bracket 312 to rotate around the rotation axis through the spare-material transmission component, so as to realize that the spare material shaft 32 can be rotatable around the rotation axis. Optionally, the mounting bracket 311 and the spare-material driving member 313 are located at two opposite sides of the mounting frame 10 respectively.

Furthermore, the spare-material transmission component includes a spare-material driving wheel 314, a spare-material driven wheel 315, a spare-material transmission belt 316, and a spare-material rotating shaft 317. The rotating bracket 312 is rotatably connected to the mounting bracket 311 through the spare-material rotating shaft 317 around the rotation axis. The spare-material driving wheel 314 is mounted on an outputting shaft of the spare-material driving member 313 to rotate synchronously with the outputting shaft of the spare-material driving member 313. The spare-material driven wheel 315 is mounted on the spare-material rotating shaft 317 to rotate synchronously with the spare-material rotating shaft 317. The spare-material transmission belt 316 is sleeved between the spare-material driving wheel 314 and the spare-material driven wheel 315, so that the spare-material driving wheel 314 and the spare-material driven wheel 315 rotate synchronously. It should be noted that the spare-material transmission component is not limited to the above-mentioned belt transmission mode, and in other embodiments, a gear transmission mode can also be used, which is not limited here. Optionally, the spare-material driving member 313 can be a motor.

Figure 9:
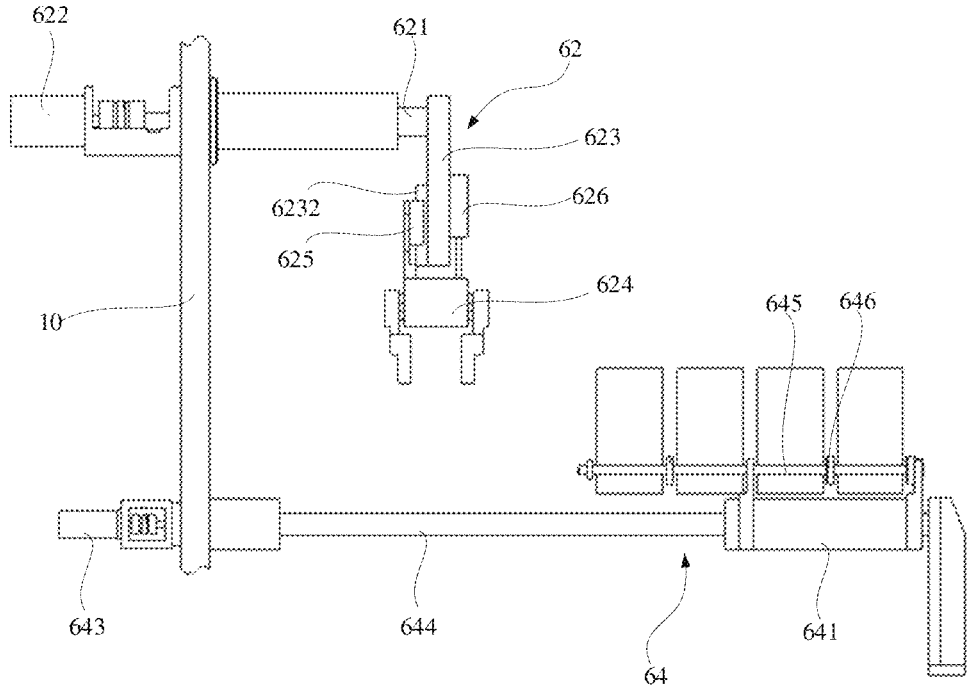
FIG. 9 is a side view of a waste collecting mechanism of the automatic roll replacing device shown in FIG. 1.

Please refer to FIG. 1 and FIG. 9 together, in an embodiment of the present application, the automatic roll replacing device further includes a waste collecting mechanism 60 for unloading a material barrel on the unwinding shaft 21. Before pushing the spare material roll on the spare material shaft 32 to the unwinding shaft 21, the material barrel on the unwinding shaft 21 needs to be unloaded, and the waste collecting mechanism 60 is used for unloading the material barrel on the unwinding shaft 21.

The waste collecting mechanism 60 includes a grabbing component 62 rotatably connected to the mounting frame 10 around a first axis. During a process of the grabbing component 62 rotating around the first axis, a grabbing position and a discharge position are provided. When the grabbing component 62 is located at the grabbing position, the grabbing component 62 is used to grab the material barrel on the unwinding shaft 21; when the grabbing component 62 is located at the discharge position, the grabbing component 62 releases the material barrel. This way, when the work material roll on the unwinding shaft is used up, the work material strip unwound from the unwinding shaft is cut off through the strip connection mechanism 40. Then the grabbing component 62 rotates around the first axis to the grabbing position, and grabs the material barrel on the unwinding shaft 21. And then the unwinding shaft 21 moves along its axis, making the material barrel be separated from the unwinding shaft 21. And then the grabbing component 62 rotates around the first axis to the discharge position, that is, transferring the material barrel separated from the unwinding shaft 21 to the discharge position and release. That is to say, automatic unloading of waste material is realized, manual unloading is avoided, labor cost is reduced, and production efficiency is improved.

In some embodiments, the grabbing component 62 includes a rotary shaft 621, a second driving member 622, a first swing arm 623, and a gripper 624. The rotary shaft 621 is rotatably connected to the mounting frame 10 around its own axis. It can be understood that an axis of the rotary shaft 621 is the above-mentioned first axis. The second driving member 622 is disposed on the mounting frame 10, and is connected with the rotary shaft 621 by transmission, so as to drive the rotary shaft 621 to rotate around its own axis. One end of the first swing arm 623 is fixedly connected to the rotary shaft 621, the gripper 624 is disposed on another end of the first swing arm 623. This way, when the second driving member 622 drives the rotary shaft 621 to rotate, the gripper 624 is driven to the grabbing position, the gripper 624 grabs the material barrel on the unwinding shaft 21, that is, the material barrel is fixed relative to the gripper 624. And the unwinding shaft 21 moves along its axis, making the material barrel be separated from the unwinding shaft 21. And then the second driving member 622 drives the rotary shaft 621 to rotate, and the gripper 624 is driven to the discharge position; at this time, the gripper 624 releases the material barrel, so that an unloading of the material barrel on the unwinding shaft 21 is realized. Optionally, the gripper 624 may be a gripper cylinder.

Specifically, in the embodiment, the grabbing component 62 further includes a first sliding block 625 and a third driving member 626. The first sliding block 625 is slidably connected to the first swing arm 623 along a longitudinal direction of the first swing arm 623. The gripper 624 is disposed on the first sliding block 625. The third driving member 626 is disposed on the first swing arm 623, and is connected with the gripper by transmission, so as to drive the gripper 624 to move along the longitudinal direction of the first swing arm 623. When the first swing arm 623 rotates around the first axis to the discharge position, the third driving member 626 drives the gripper 624 with one material barrel to move along the longitudinal direction of the first swing arm 623, making the gripper 624 close to a material storage area, and the material barrel can be easily put down to avoid impact. Optionally, the third driving member 626 may be a cylinder.

Furthermore, a guiding rail 6232 is provided on one side of the first swing arm 623, the first sliding block 625 is disposed on the guiding rail 6232, and can move along the guiding rail 6232. Another side of the first swing arm 623 is provided with the third driving member 626. That is to say, the first sliding block 625 and the third driving member 626 are located at two opposite sides of the first swing arm 623 respectively. This way, movement of the gripper 624 is more stable and reliable.

Specifically, in the embodiment, an outputting shaft of the second driving member 622 can be connected with the rotary shaft 621 by transmission through a shaft coupling. Optionally, the second driving member 622 can be a motor. More specifically, the second driving member 622 can be fixed mounted on the mounting frame 10 through a fixed seat, so as to ensure connection stability of the second driving member 622, and to weaken a vibration of the second driving member 622.

In some embodiments, the waste collecting mechanism 60 further includes a storage component 64. The storage component 64 is located below the grabbing component 62. The storage component 64 includes a sliding seat 641. The sliding seat 641 is provided with a plurality of material storage areas arranged at intervals along a first direction for storing the material barrels (a "plurality" of a plurality of material storage areas should be understood to mean two or more). The sliding seat 641 is slidably connected to the mounting frame 10 along the first direction, so as to drive the plurality of material storage areas to sequentially move to a lower part of the discharge position, so as to be convenient for receiving the material barrels released by the gripper 624. This way, the grabbing component 62 releases the material barrels at the discharge position, so that the material barrels fall into the material storage areas. And when one material storage area is full of material barrels, the sliding seat 641 moves along the first direction, so that another material storage area moves to the lower part of the discharge position.

Preferably, the first direction is parallel to the first axis. This way, it is beneficial to reduce a volume occupied by the waste collecting mechanism 60 in a direction perpendicular to the first axis.

Specifically, in the embodiment, the storage component 64 further includes a second lead screw and a fourth driving member 643. The second lead screw is rotatably connected to the mounting frame 10 around its own axis. The sliding seat 641 is threadedly connected to the second lead screw. The fourth driving member 643 is disposed on the mounting frame 10, and is connected with the second lead screw by transmission, so as to drive the second lead screw rotate around its own axis. This way, the fourth driving member 643 drives the second lead screw to rotate, making the sliding seat 641 rotate along an axial direction of the second lead screw, so as to sequentially move the plurality of material storage areas to the lower part of the discharge position. It can be understood that an axis of the second lead screw is parallel to the first direction. More specifically, the storage component 64 further includes a second lead screw nut. The second lead screw nut is threadedly connected to the second lead screw. The sliding seat 641 is fixedly connected to the second lead screw nut. That is to say, the sliding seat 641 is indirectly threadedly connected to the second lead screw through the second lead screw nut.

Furthermore, the storage component 64 further includes a guiding lever 644. One end of the guiding lever 644 is fixedly connected to the mounting frame 10, and is parallel to the second lead screw. The sliding seat 641 is slidably connected to the guiding lever 644. This way, sliding of the sliding seat 641 is guided by the guiding lever 644, so that movement of the sliding seat 641 is more stable and reliable.

Optionally, the fourth driving member 643 may be a motor. An outputting shaft of the fourth driving member 643 may be connected to the second lead screw through a shaft coupling.

Specifically, in the embodiment, the storage component 64 further includes two supporting levers 645. The two supporting levers 645 are fixedly connected to the sliding seat 641. The two supporting levers 645 are arranged at intervals and both parallel to the first direction. Material storage space for carrying the material barrels is defined between the two supporting levers 645. The material storage space includes a plurality of the material storage areas arranged along the first direction. This way, the material barrels can be placed in the material storage areas in the storage space from above-mentioned the supporting levers 645, so that the supporting levers 645 carry the material barrels to realize storage. When the material barrels need to be unloaded, the material barrels can be separated from the supporting levers 645 by simply lifting them up. It should be noted that in order to realize carrying of the material barrels, a distance between the two supporting levers 645 is smaller than a diameter of the material barrel.

Furthermore, the storage component 64 further includes a plurality of spacers 646. The plurality of spacers 646 are fixedly connected to the two supporting levers 645, and are arranged at intervals in a longitudinal direction of the supporting lever 645, so as to separate the plurality of material storage areas (that is, one spacer 646 is arranged between every two adjacent material storage areas). That is to say, the plurality of spacers 646 divide the material storage space into a plurality of material storage areas along the longitudinal direction of the supporting lever 645, and each of the material storage areas is used to store one material barrel. This way, an arrangement of the spacers 646 effectively avoids a mutual influence between the two material barrels located in the two adjacent material storage areas.

Figure 10:
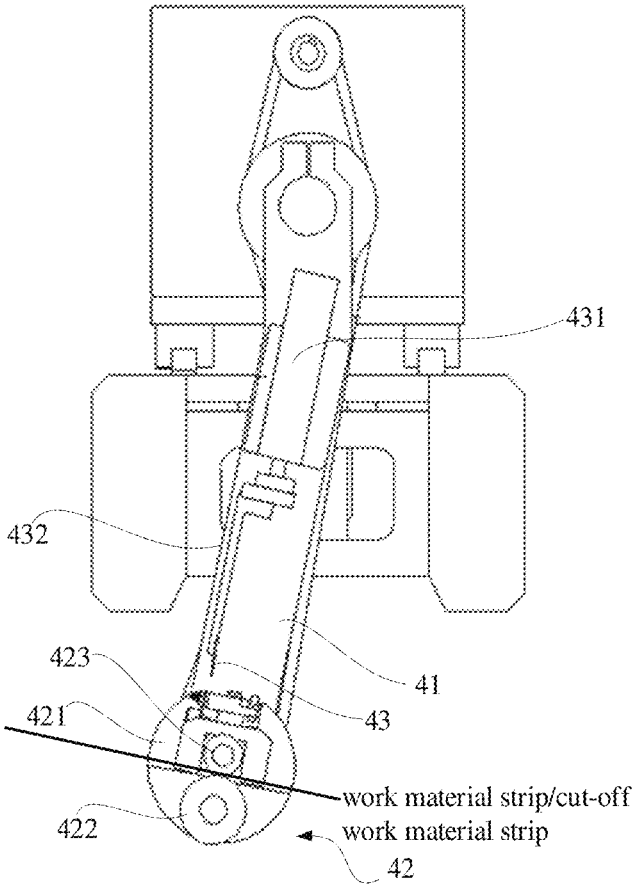
FIG. 10 is a front view of a strip connection mechanism of an automatic roll replacing device in a first embodiment of the present application.
Figure 11:
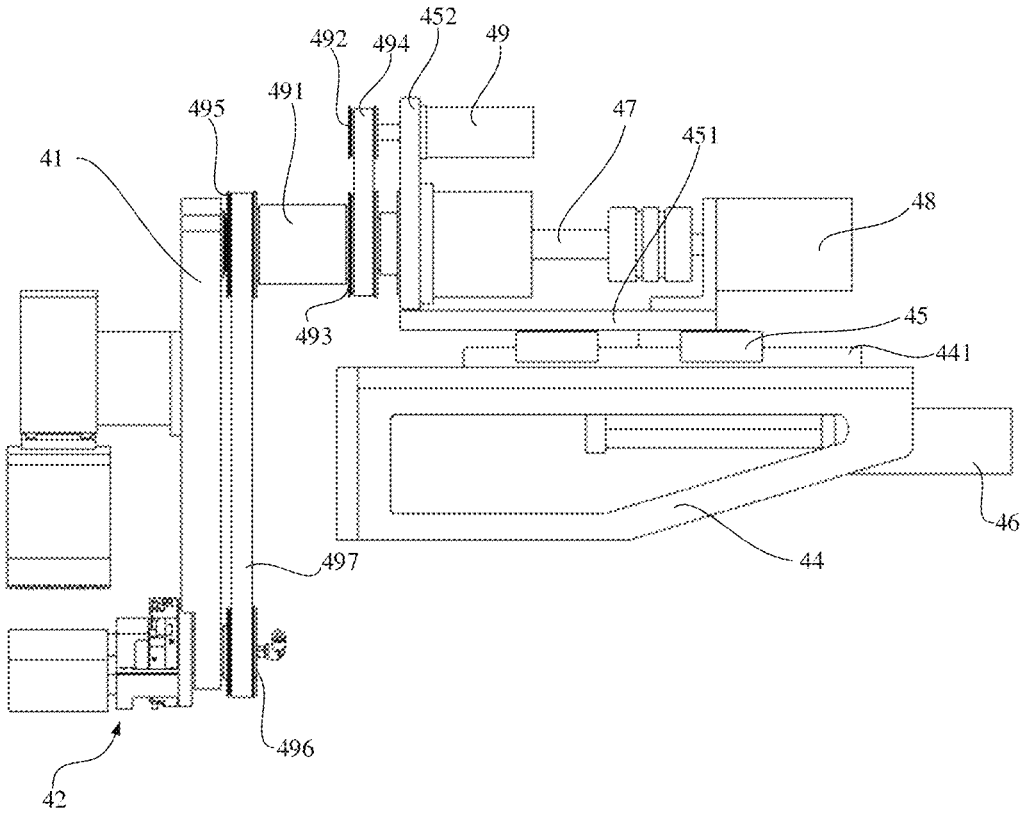
FIG. 11 is a side view of the strip connection mechanism shown in FIG. 10.
Figure 12:
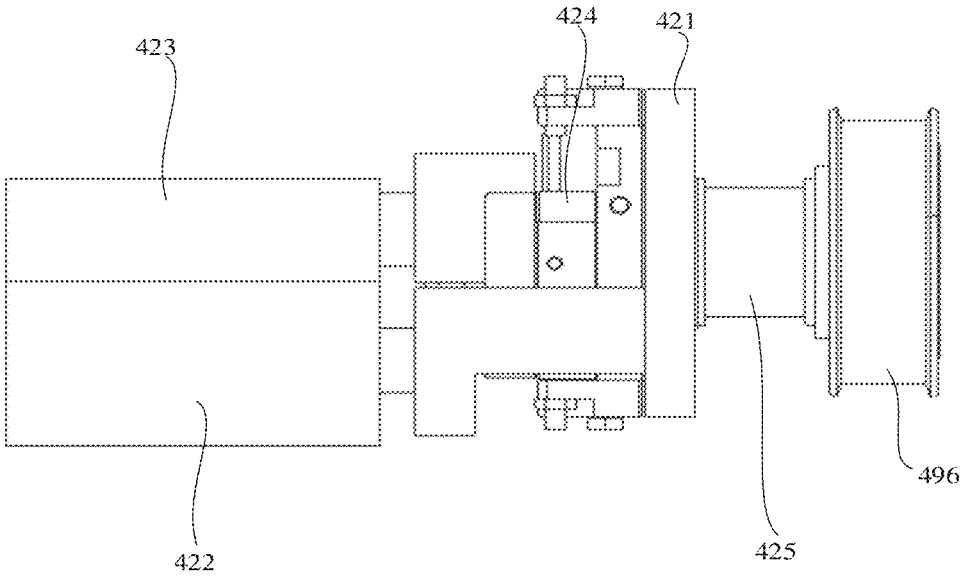
FIG. 12 is a schematic structural view of a clamping component of the strip connection mechanism shown in FIG. 10.

Please refer to FIG. 10, FIG. 11, and FIG. 12 together, in a first embodiment of the present application, the strip connection mechanism 40 includes a second swing arm 41, a first clamping component 42, and a first cutting tool 43. One end of the second swing arm 41 is rotatably connected to the mounting frame 10 around a second axis; the first clamping component 42 is rotatably connected to another end of the second swing arm 41 around a third axis, the first clamping component 42 is used to clamp the work material strip; the first cutting tool 43 is disposed on the second swing arm 41 and can approach or move away from the first clamping component 42, and the first cutting tool 43 is used to cut off the material strip. This way, when the automatic roll replacing device is required to replace roll, the first clamping component 42 of the strip connection mechanism 40 clamps the work material strip unwound from the unwinding shaft 21. The first cutting tool then approaches the first clamping component 42 to cut off a clamped work material strip. Then, the waste collecting mechanism 60 unloads the material barrels on the unwinding shaft 21, and the material pushing member 33 pushes the spare material roll on the spare material shaft 32 to the unwinding shaft 21, and positions the spare material roll on the unwinding shaft 21. The first clamping component 42 rotates around the third axis so that the cut-off work material strip is partially wrapped around outside of the first clamping component 42. Finally, the second swing arm 41 rotates, so that the work material strip clamped by the first clamping component 42 is close to the spare material roll on the unwinding shaft 21, so that the work material strip is pasted on the spare material roll on the unwinding shaft 21.

Preferably, the second axis is parallel to the axis of the unwinding shaft 21. The third axis is parallel to the second axis.

In some embodiments, the first clamping component 42 includes a first turntable 421, a fixed clamping roller 422, and a movable clamping roller 423. The first turntable 421 is rotatably connected to one end of the second swing arm 41 around the third axis. The fixed clamping roller 422 is mounted on the first turntable 421, the movable clamping roller 423 can be connected to the first turntable 421 toward or away from the fixed clamping roller 422. This way, clamping or loosening of the work material strip is realized by moving the movable clamping roller 423 toward or away from the fixed clamping roller 422. That is to say, when the work material strip needs to be clamped, the movable clamping roller 423 moves toward a direction close to the fixed clamping roller 422, so as to clamp the work material strip between the movable clamping roller 423 and the fixed clamping roller 422. When the work material strip is connected to the spare material roll, and the work material strip needs to be loosened, the movable clamping roller 423 moves in a direction away from the fixed clamping roller 422, thereby releasing the work material strip. Moreover, when the work material strip is pasted on the spare material roll, the first turntable 421 rotates, so that the cut-off work material strip is partially wrapped around the fixed clamping roller 422 or the movable clamping roller 423, and faces the spare material roll for easy pasting. It should be noted that in order to better clamp the work material strip unwound from the unwinding shaft 21, the movable clamping roller 423 and the fixed clamping roller 422 are both parallel to the second axis, that is, parallel to the unwinding shaft 21.

Specifically, in the embodiment, one of the fixed clamping roller 422 and the movable clamping roller 423 can rotate around its own axis. That is to say, when the fixed clamping roller 422 and the movable clamping roller 423 clamp the work material strip, when certain external force pulls the work material strip, the fixed clamping roller 422 or the movable clamping roller 423 can be driven to rotate around its own axis. This way, rotation of the second swing arm 41 makes the work material strip clamped by the movable clamping roller 423 and the fixed clamping roller 422 close to the spare material roll on the unwinding shaft 21, until the fixed clamping roller 422 or the movable clamping roller 423 wrapped with the work material strip is pressed against the spare material roll, so that the work material strip is pasted on the spare material roll. Then the spare material roll rotates with the unwinding shaft 21, so as to drive the fixed clamping roller 422 or the movable clamping roller 423 to rotate around its own axis through the work material strip; so as to completely paste a tail end of the work material strip to the spare material roll, avoid an phenomenon that a part of the tail end of the work material strip is not pasted to the spare material roll to form a free end from being easy to shake to drop powder during a strip running process and further affecting product quality. Preferably, the fixed clamping roller 422 is rotatable around its own axis. This way, before the work material strip is pasted on the spare material roll, the first turntable 421 rotates, so that the cut-off work material strip is partially wrapped on the fixed clamping roller 422 and faces the spare material roll.

Specifically, in the embodiment, the first clamping component 42 further includes a fifth driving member 424 disposed on the first turntable 421. The fifth driving member 424 is connected with the movable clamping roller 423 by transmission, so as to drive the movable clamping roller 423 to approach or move far away from the fixed clamping roller 422. More specifically, the movable clamping roller 423 is mounted on a driving end of the fifth driving member 424 through a movable clamping roller seat. Optionally, the fifth driving member 424 can be a gripper cylinder.

Specifically, in the embodiment, the fixed clamping roller 422 may be fixedly connected to the first turntable 421 through a fixed clamping roller seat, making connection of the fixed clamping roller 422 more stable.

Furthermore, the first clamping component 42 further includes a second elastic member arranged between the movable clamping roller seat and the fixed clamping roller seat; the second elastic member is used to provide pre-tightening force that makes the movable clamping roller seat move away from the fixed clamping roller seat. This way, an arrangement of the second elastic member, on one hand, plays a buffering role to avoid rigid impact on the work material strip from damaging to the work material strip when the movable clamping roller 423 and the fixed clamping roller 422 clamp the work material strip. On another hand, the fifth driving member 424 drives the movable clamping roller 423 and cooperates with the fixed clamping roller 422 to clamp the work material strip, while compressing the second elastic member. When the work material strip needs to be loosened, the fifth driving member 424 unloads force, and the movable clamping roller 423 moves away from the fixed clamping roller 422 under an action of the second elastic member, thereby releasing the work material strip. Therefore, the fifth driving member 424 can adopt a single-air-path gripper cylinder, thereby reducing air paths and reducing a risk of entanglement of the air paths.

Specifically, in the embodiment, the strip connection mechanism 40 further includes a first fixing frame 44, a second sliding block 45, and a sixth driving member 46. The first fixing frame 44 is fixedly connected to the mounting frame 10. The second sliding block 45 is movably connected to the first fixing frame 44 along a direction parallel to the second axis. One end of the second swing arm 41 away from the first clamping component 42 is rotatably connected to the second sliding block 45 around the second axis. The sixth driving member 46 is mounted on the first fixing frame 44 and is connected with the second sliding block 45 by transmission to drive the second sliding block 45 to move in the direction parallel to the second axis. This way, when it is necessary to clamp the work material strip unwound from the unwinding shaft 21, the sixth driving member 46 drives the second sliding block 45 to move in the direction parallel to the second axis (i.e., parallel to a direction of the unwinding shaft 21), so that the fixed clamping roller 422 and the movable clamping roller 423 of the first clamping component 42 are driven to move in the direction parallel to the second axis, so that the work material strip is inserted between the fixed clamping roller 422 and the movable clamping roller 423. Then the movable clamping roller 423 moves toward a direction close to the fixed clamping roller 422 to realize clamping of the work material strip between the movable clamping roller 423 and the fixed clamping roller 422. Optionally, the sixth driving member 46 may be a translation cylinder.

Furthermore, a second sliding rail 441 is provided on the first fixing frame 44, the second sliding block 45 is slidably mounted on the second sliding rail 441. That is, the second sliding block 45 can slide along the second sliding rail 441.

Specifically, in the embodiment, the strip connection mechanism 40 further includes a first swing shaft 47 and a seventh driving member 48. The first swing shaft 47 is rotatably connected to the second sliding block 45 around its own axis. One end of the second swing arm 41 away from the first clamping component 42 is fixedly connected to the first swing shaft 47, making the second swing arm 41 and the first swing shaft 47 rotate synchronously. The seventh driving member 48 is disposed on the second sliding block 45 and is connected with the first swing shaft 47 by transmission, so as to drive the first swing shaft 47 to rotate around its own axis. It can be understood that an axis of the first swing shaft 47 is the above-mentioned second axis. This way, the seventh driving member 48 drives the first swing shaft 47 to rotate, so that the end of the second swing arm 41 away from the first clamping component 42 rotates around the second axis. When the cut-off work material strip needs to be pasted on the spare material roll, the seventh driving member 48 drives the first swing shaft 47 to rotate, therefore, the second swing arm 41 drives the first clamping component 42 to rotate to the spare material roll on the unwinding shaft 21; and at a same time, the first turntable 421 rotates, the cut-off work material strip is partially wrapped on the fixed clamping roller 422 or the movable clamping roller 423, and faces the spare material roll. Furthermore, an outputting shaft of the seventh driving member 48 is connected with the first swing shaft 47 by transmission through a shaft coupling. Optionally, the seventh driving member 48 may be a motor.

Furthermore, the first clamping component 42 further includes an eighth driving member 49 and a first transmission component. The eighth driving member 49 is fixedly mounted relative to the second sliding block 45. The first transmission component is connected between the eighth driving member 49 and the first turntable 421 by transmission, so that the eighth driving member 49 drives the first turntable 421 to rotate through the first transmission component.

Furthermore, the first transmission component includes a first transmission shaft 491. The first transmission shaft 491 is connected with the eighth driving member 49 and the first turntable 421 respectively by transmission, so as to transmit rotational motion output by the eighth driving member 49 to the first turntable 421. Moreover, the first transmission component further includes a first driving wheel 492, a first main transmission wheel 493, a first transmission belt 494, a first auxiliary transmission wheel 495, a first driven wheel 496, and a second transmission belt 497. The first driving wheel 492 is mounted on an outputting shaft of the eighth driving member 49, so as to rotate synchronously with the outputting shaft of the eighth driving member 49. The first main transmission wheel 493 is mounted on one end of the first transmission shaft 491, so as to rotate synchronously with the first transmission shaft 491. The first transmission belt 494 is sleeved between the first driving wheel 492 and the first main transmission wheel 493, making the first driving wheel 492 and the first main transmission wheel 493 rotate synchronously. The first auxiliary transmission wheel 495 is mounted on another end of the first transmission shaft 491, so as to rotate synchronously with the first transmission shaft 491. The first driven wheel 496 is mounted on the first turntable 421, so as to rotate synchronously with the first turntable 421. The second transmission belt 497 is sleeved between the first auxiliary transmission wheel 495 and the first driven wheel 496, making the first auxiliary transmission wheel 495 and the first driven wheel 496 rotate synchronously. This way, rotation of the outputting shaft of the eighth driving member 49 drives the first driving wheel 492, the first main transmission wheel 493, the first transmission shaft 491, the first auxiliary transmission wheel 495, the first driven wheel 496, and the first turntable 421 to rotate in sequence. It should be noted that transmission connection between the first transmission shaft 491 and the eighth driving member 49 and the first turntable 421 is not limited to belt transmission. In other embodiments, it can also be realized by gear transmission, chain transmission, etc., which is not limited here.

Furthermore, the first transmission shaft 491 may be a hollow shaft. The first transmission shaft 491 is coaxially sleeved outside of the first swing shaft 47 and is rotatable relative to the first swing shaft 47. This way, the first transmission shaft 491 and the first swing shaft 47 are sleeved to make a structure more compact, which is beneficial to simplify the structure and reduce occupied space. Optionally, the first transmission shaft 491 may be coaxially mounted outside of the first swing shaft 47 through a bearing.

Specifically, in one embodiment, the first strip connection mechanism 40 further includes a first sliding plate 451 and a first shaft mounting seat 452. The first sliding plate 451 is fixedly connected to the second sliding block 45. The seventh driving member 48 is fixedly mounted on the first sliding plate 451. The first shaft mounting seat 452 is fixedly connected to the first sliding plate 451. The first swing shaft 47 is rotatably connected to the first shaft mounting seat 452 around its own axis. The first transmission shaft 491 is sleeved outside of the first swing shaft 47. The eighth driving member 49 is fixedly mounted on the first shaft mounting seat 452. Optionally, the second sliding block 45 may include two or more than two, so as to further improve stability of an action of the strip connection mechanism 40.

Specifically, in one embodiment, the first clamping component 42 further includes a first rotating shaft 425, the first rotating shaft 425 is rotatably connected to the second swing arm 41 around its own axis. The turntable 421 is fixedly connected to the first rotating shaft 425, so as to rotate synchronously with the first rotating shaft 425. The first driven wheel is fixedly mounted on the first rotating shaft 425, so as to rotate synchronously with the first rotating shaft 425. Furthermore, the first rotating shaft 425 is defined with a central hole along its axis, and an air path of the fifth driving member 424 penetrates through the central hole of the first rotating shaft 425, and is connected with an air joint. This way, entanglement of the air path caused by the rotation of the first rotating shaft 425 can be avoided.

In some embodiments, the strip connection mechanism 40 further includes a first cutting driving member 431 and a first cutting tool holder 432. The first cutting driving member 431 is fixedly mounted on the second swing arm 41; the first cutting tool holder 432 is fixedly mounted on a driving end of the first cutting driving member 431, and faces the first clamping component 42; the first cutting tool 43 is mounted on one end of the first cutting tool holder 432 facing the first clamping component 42. The first cutting driving member 431 drives the first cutting tool holder 432 to approach or move away from the first clamping component 42, making the first cutting tool 43 cut off the work material strip clamped by the movable clamping roller 423 and the fixed clamping roller 422, and then returns to an initial position. Optionally, the first cutting driving member 431 may be a cylinder.

Figure 13:
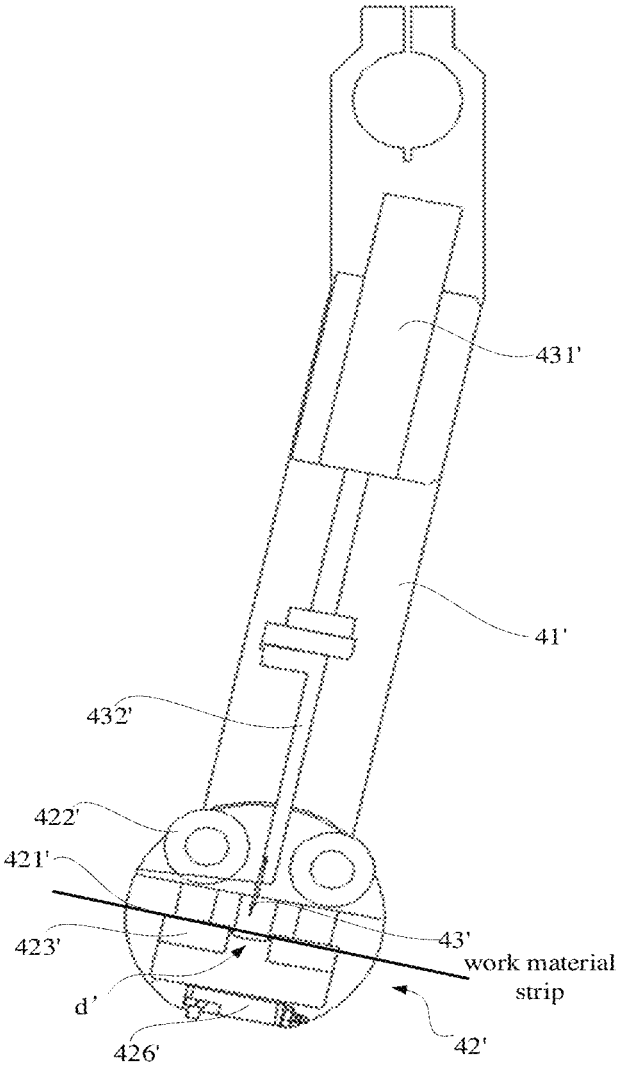
FIG. 13 is a front view of a strip connection mechanism of an automatic roll replacing device in a second embodiment of the present application.
Figure 14:
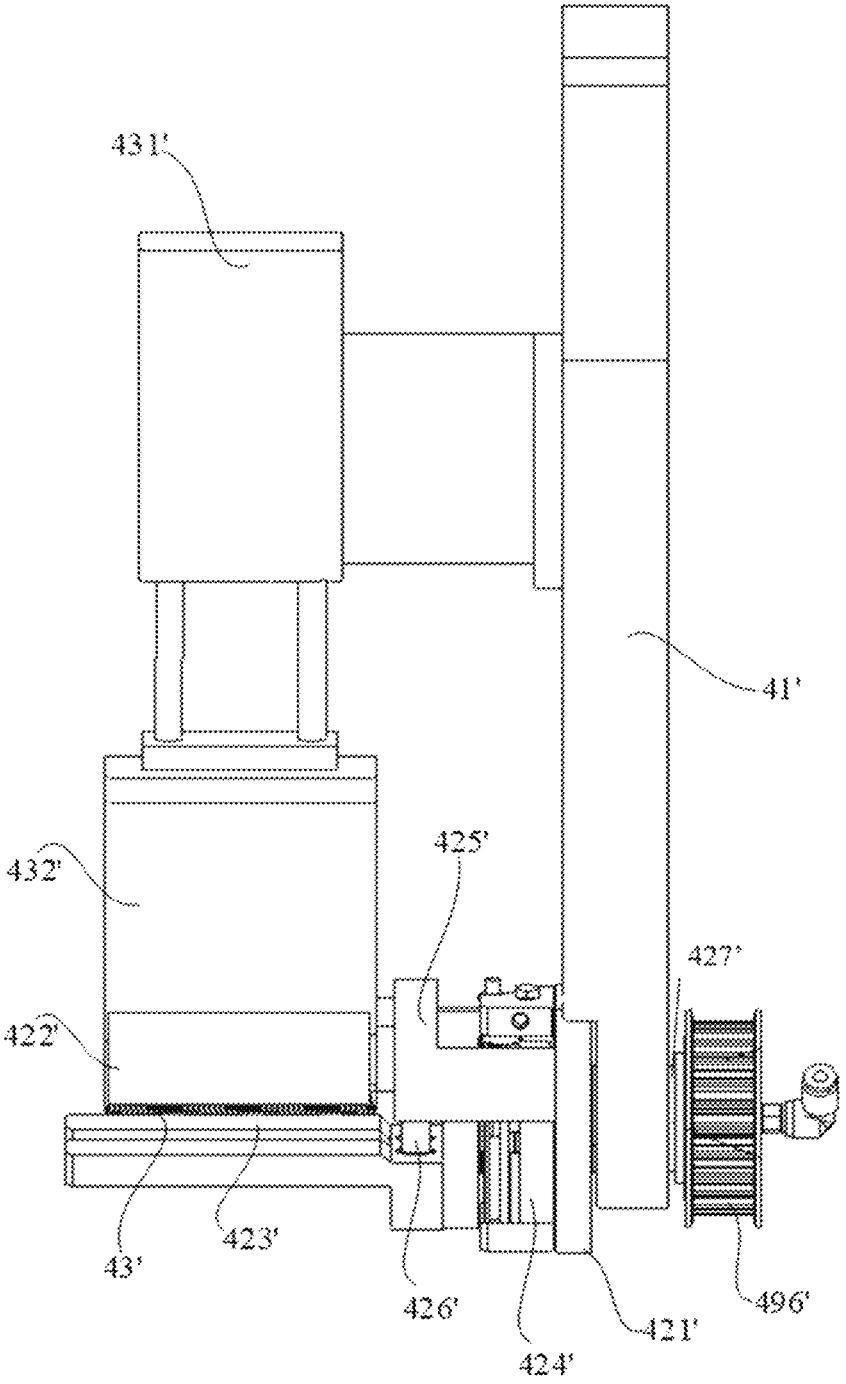
FIG. 14 is a partial side view of the strip connection mechanism shown in FIG. 13.
Figure 15:
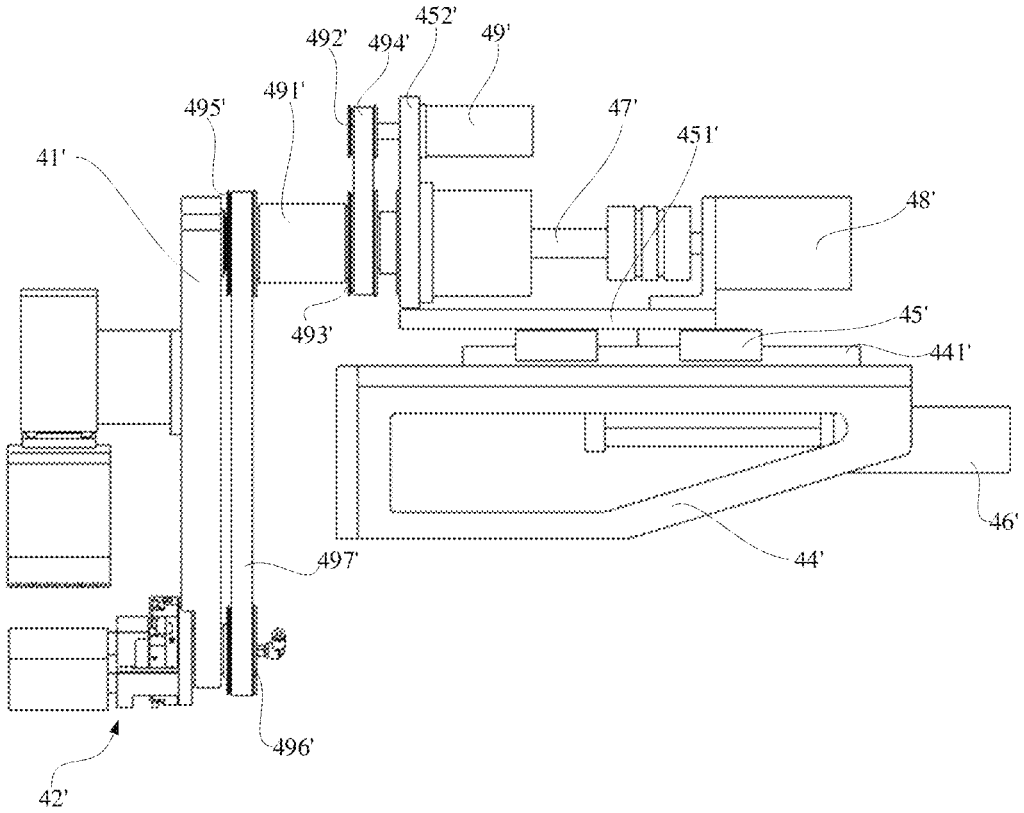
FIG. 15 is a side view of the strip connection mechanism shown in FIG. 13.

It should be noted that the automatic roll replacing device of the present application is not limited to use of the strip connection mechanism 40 in the above-mentioned embodiment to realize cutting and pasting the work material strip on the spare material roll. Please refer to FIG. 12, FIG. 13, and FIG. 14, in a second embodiment of the present application, the strip connection mechanism 40' includes a moving member 41', a second clamping component 42' used for clamping the work material strip, and a second cutting tool 43' used for cutting off the work material strip. The moving member 41' is movably disposed on the mounting frame 10 approaching or moving away from the spare material roll. The second clamping component 42' is rotatably connected to the moving member 41' around a third axis. This way, when the work material strip needs to be pasted on the spare material roll during a roll replacing process, the second clamping component 42' of the strip connection mechanism 40' clamps the work material strip. The second cutting tool 43' cuts off the work material strip. The second clamping component 42' rotates around the third axis so that a part of the work material strip is wrapped on an outside wall of the second clamping component 42'; the moving member 41' drives the second clamping component 42' to approach the spare material roll on the unwinding shaft 21, so as to paste the work material strip on the spare material roll on the unwinding shaft 21.

In the embodiment, the second clamping component 42' includes a second turntable 421', at least two first clamping rollers 422', and a clamping plate 423'. The second turntable 421' is rotatably connected to the moving member 41' around the third axis. Each of the first clamping rollers 422' is disposed on the second turntable 421', the clamping plate 423' is disposed on the second turntable 421'.

Wherein, at least one of the at least two first clamping rollers 422' and the clamping plate 423' can approach or move away from another of the at least two first clamping rollers 422' and the clamping plate 423' under an action of external force, so as to form a clamping position for clamping the work material strip which is located between the at least two first clamping rollers 422' and the clamping plate 423'. That is to say, the clamping plate 423' can approach or move away from the at least two first clamping rollers 422'; optionally, the clamping plate 423' is fixedly connected to the second turntable 421', and the at least two first clamping rollers 422' can approach or move away from the clamping plate 423'. Optionally, both the at least two first clamping rollers 422' and the clamping plate 423' can approach each other or move away from each other.

The second cutting tool 43' is disposed on the moving member 41', and can cut into or out of the clamping position between any two adjacent first clamping rollers 422'. When the work material strip needs to be cut off, the cutting tool 43' is cut into the clamping position between two adjacent first clamping rollers 422', so that the work material strip clamped at the clamping position is cut off, and then the second cutting tool 43' exits the clamping position between the two adjacent first clamping rollers 422' and returns to an initial position.

The above-mentioned strip connection mechanism 40' utilizes at least two first clamping rollers 422' and the clamping plate 423' to form the clamping position for clamping the work material strip; and the second cutting tool 43' is cut into the clamping position between any two first clamping rollers 422', thereby cutting off the work material strip clamped at the clamping position. Compared with the prior art when a cutting tool cuts a work material strip, only the work material strip on one side of the cutting tool is compressed; in this embodiment, when the second cutting tool 43' cuts the work material strip, the first clamping rollers 422' on both sides of the second cutting tool 43' press the work material strip against the clamping plate 423', so as to effectively avoid being worn of a cutting surface, reduce burrs, and have a good cutting effect, which is beneficial to improve product quality.

Specifically, in the embodiment, one side of the clamping plate 423' facing the at least two first clamping rollers 422' is provided with a clamping surface, and each of the first clamping rollers 422' is arranged at intervals along the clamping surface, and the first clamping rollers 422' are parallel to each other.

More specifically, the second clamping component 42' includes two first clamping rollers 422'; a cutting channel for the second cutting tool 43' passing through is defined between the two first clamping rollers 422'. The clamping surface is provided with an avoidance slot d' corresponding to the cutting channel. This way, the second cutting tool 43' can cut into the clamping position through the cutting channel to the avoidance slot d', thereby cutting the work material strip. On one hand, setting of the avoidance slot d' ensures that the work material strip is cut off; on another hand, the second cutting tool 43' is prevented to contact with the clamping plate 423' from damaging the clamping plate 423' and the second cutting tool 43'.

It should be noted that in one embodiment, a cutting position is provided in a moving process of the second cutting tool 43'; when the second cutting tool 43' is located at the cutting position, the second cutting tool 43' cuts into the avoidance slot d' through the cutting channel. This way, when the second cutting tool 43' cuts into the avoidance slot d' through the cutting channel to the cutting position, the work material strip on the clamping surface is cut off.

Specifically, in the embodiment, each of the first clamping rollers 422' can be rotatably connected to the second turntable 421' around its own axis. This way, clamping or loosening of the work material strip is realized by the clamping plate 423' and the at least two first clamping rollers 422' approaching or moving away from each other. When the work material strip is pasted on the spare material roll, the second turntable 421' rotates, so that the work material strip is partially wrapped on one first clamping roller 422' located outside, and faces the spare material roll on the spare material shaft 32. The moving member 41' moves, so that the first clamping roller 422' wrapped with the work material strip is pressed against the spare material roll, so that the work material strip is pasted on the spare material roll. Since the first clamping roller 422' can rotate around its own axis; when the first clamping roller 422' is pressed against the spare material roll, the unwinding shaft 21 can drive the spare material roll to rotate, so as to drive the first clamping roller 422' to roll through the work material strip, and then paste an entire tail end of the work material strip to the spare material roll, avoiding an phenomenon that there is a small section at the tail end of the work material strip that cannot be pasted on a tail end of the spare material roll, which is beneficial to improve product quality.

It should be noted, the second cutting tool 43' is cut into the clamping position between the two adjacent first clamping rollers 422' to cut off the work material strip; and a length of the tail end of the work material strip is shorter (that is, a length from the cutting surface of the work material strip to a position clamped by the first clamping rollers 422' and the clamping plate 423'), which is beneficial to simplify an operation of pasting the entire tail end of the work material strip to the spare material roll, that is, simplifying a pasting action and improving reliability of the pasting action.

Specifically, in the embodiment, the moving member 41' is a swing arm, one end of the moving member 41' is rotatably connected to the mounting frame 10 around the second axis, and the second turntable 421' is rotatably connected to another end of the moving member 41' around the third axis. Wherein, during a process of the moving member 41' rotating around the second axis, the clamping component 42' can approach or move away from the spare material roll on the unwinding shaft 21. This way, through the rotation of the moving member 41' around the second axis, the second clamping component 42' can approach or move away from the spare material roll on the unwinding shaft 21, which is beneficial to keep stability and reliability of a strip connection process and reduce occupied space.

Preferably, the second axis is parallel to the axis of the unwinding shaft 21. The third axis is parallel to the second axis. It should be noted that in order to better clamp the work material strip unwound from the unwinding shaft 21, each of the first clamping rollers 422' is parallel to the second axis, that is, parallel to the unwinding shaft 21.

It should also be noted that in order to drive the second clamping component 42' to approach or move away from the spare material roll, it is not limited to a swinging form of the swing arm in the above-mentioned embodiment. In other embodiments, the moving member can also be implemented by moving along a straight line or a curve, which is not limited here.

In one embodiment, the second clamping component 42' further includes a ninth driving member 424' disposed on the second turntable 421'. The ninth driving member 424' is connected with the clamping plate 423' by transmission, so as to drive the clamping plate 423' to approach or move away from each of the first clamping rollers 422'. That is, the clamping plate 423' moves relative to the second turntable 421', while each of the first clamping rollers 422' can not move relative to the second turntable 421'. More specifically, the clamping plate 423' is mounted on a driving end of the ninth driving member 424' through a clamping plate seat. Each of the first clamping rollers 422' is mounted on the second turntable 421' through a fourth mounting seat 425'.

In another embodiment, the second clamping component 42' further includes a fourth mounting seat 425' and a ninth driving member 424'; and each of the first clamping rollers 422' is mounted on the fourth mounting seat 425'; the fourth mounting seat 425' is disposed on the second turntable 421'. The ninth driving member 424' is disposed on the second turntable 421', and is connected with the fourth mounting seat 425' by transmission to drive the fourth mounting seat 425' mounted with the first clamping rollers 422' to approach or move away from the clamping plate 423'. That is, the fourth mounting seat 425' and each of the first clamping rollers 422' mounted on the fourth mounting seat 425' move relative to the second turntable 421', while the clamping plate 423' can not move relative to the second turntable 421'.

In yet another embodiment, each of the first clamping rollers 422' is mounted on a fourth mounting seat 425'; and the fourth mounting seat 425' is mounted on the second turntable 421'; the ninth driving member 424' includes two, and the two ninth driving members 424' are disposed on the second turntable 421' and are connected to the clamping plate 423' and the fourth mounting seat 425' by transmission respectively to drive the clamping plate 423' and the fourth mounting seat 425' mounted with the first clamping rollers 422' respectively to move, so as to approach or move away from each other. That is, both the fourth mounting seat 425' mounted with the first clamping rollers 422' and the clamping plate 423' can move relative to the second turntable 421'.

Optionally, the ninth driving member 424' may be a gripper cylinder.

In some embodiments, the second clamping component 42' further includes a third elastic member 426'; the first clamping rollers 422' are disposed on the fourth mounting seat 425', and the fourth mounting seat 425' is disposed on the second turntable 421'. The third elastic member 426' is disposed between the fourth mounting seat 425' and the clamping plate 423' to provide elastic force that causes the fourth mounting seat 425' and the clamping plate 423' to move in a direction facing away from each other. This way, when the first clamping rollers 422' and the clamping plate 423' are close to each other to clamp the work material strip, an arrangement of the third elastic member 426' plays a buffering role of avoiding rigid impact between the first clamping rollers 422' and the clamping plate 423'. It should also be noted that, the ninth driving member 424' drives the fourth mounting seat 425' and the clamping plate 423' to approach each other, so that the clamping plate 423' and the at least two first clamping rollers 422' clamp the work material strip, while compressing the third elastic member 426'. When the work material strip needs to be loosened, the ninth driving member 424' unloads force, and the fourth mounting seat 425' and the clamping plate 423' move away from each other under an action of the third elastic member 426', thereby loosening the work material strip. Therefore, the ninth driving member 424' can adopt a single-air-path gripper cylinder, thereby reducing air paths and reducing a risk of entanglement of the air paths.

Specifically, in the embodiment, the strip connection mechanism 40' further includes a second fixing frame 44', a third sliding block 45', and a tenth driving member 46'. The second fixing frame 44' is fixedly connected to the mounting frame 10. The third sliding block 45' is movably connected to the second fixing frame 44' in a direction parallel to the second axis. One end of the moving member 41' away from the second clamping component 42' is rotatably connected to the third sliding block 45' around the second axis. The tenth driving member 46' is mounted on the second fixing frame 44', and is connected with the third sliding block 45' by transmission, so as to drive the third sliding block 45' to move in a direction parallel to the second axis. This way, when the work material strip unwound from the unwinding shaft 21 needs to be clamped, the tenth driving member 46' drives the third sliding block 45' to move along the direction parallel to the second axis (i.e., the direction parallel to the unwinding shaft 21). Therefore, the first clamping rollers 422' and the clamping plate 423' of the second clamping component 42' are driven to move in the direction parallel to the second axis, so that the work material strip is inserted between the first clamping rollers 422' and the clamping plate 423'. first clamping rollers 422' and the clamping plate 423' approach each other to achieve clamping of the work material strip between the clamping plate 423' and the first clamping rollers 422'. Optionally, the tenth driving member 46' may be a translation cylinder.

Furthermore, the second fixing frame 44' has a third sliding rail 441', and the third sliding block 45' is slidably disposed on the third sliding rail 441'. That is, the third sliding block 45' can slide along the third sliding rail 441'.

Specifically, in the embodiment, the strip connection mechanism 40' further includes a second swing shaft 47' and an eleventh driving member 48'. The second swing shaft 47' is rotatably connected to the third sliding block 45' around its own axis. One end of the moving member 41' away from the second clamping component 42' is fixedly mounted on the second swing shaft 47', so that the moving member 41' and the second swing shaft 47' can rotate synchronously. The eleventh driving member 48' is disposed on the third sliding block 45', and is connected with the second swing shaft 47' by transmission to drive the second swing shaft 47' to rotate around its axis. It can be understood that an axis of the second swing shaft 47' is the above-mentioned second axis. This way, the second swing shaft 47' is driven to rotate through the eleventh driving member 48', thereby realizing that one end of the moving member 41' away from the second clamping component 42' rotates around the second axis. When the cut-off work material strip needs to be pasted on the spare material roll, the eleventh driving member 48' drives the second swing shaft 47' to rotate, so that the moving member 41' drives the second clamping component 42' to swing to the unwinding shaft 21 at the spare material roll; at a same time, the second turntable 421' rotates, so that the cut-off work material strip is partially wrapped on one of the first clamping rollers 422 located outside, and faces the spare material roll.

Furthermore, an outputting shaft of the eleventh driving member 48' is connected with the second swing shaft 47' by transmission through a coupling. Optionally, the eleventh driving member 48' may be a motor.

Furthermore, the second clamping component 42' further includes a twelfth driving member 49' and a second transmission component, and the twelfth driving member 49' is fixedly mounted relative to the third sliding block 45'. The second transmission component is connected between the twelfth driving member 49' and the second turntable 421', so that the twelfth driving member 49' drives the second turntable 421' to rotate through the second transmission component.

Furthermore, the second transmission component includes a second transmission shaft 491'. The second transmission shaft 491' is connected with the twelfth driving member 49' and the second turntable 421' by transmission respectively, so as to transmit rotational motion output by the twelfth driving member 49' to the second turntable 421'. Furthermore, the second transmission component further includes a second driving wheel 492', a second main transmission wheel 493', a third transmission belt 494', a second auxiliary transmission wheel 495', a second driven wheel 496', and a fourth transmission belt 497'. The second driving wheel 492' is mounted on an outputting shaft of the twelfth driving member 49' to rotate synchronously with the outputting shaft of the twelfth driving member 49'. The second main transmission wheel 493' is mounted on one end of the second transmission shaft 491' to rotate synchronously with the second transmission shaft 491'. The third transmission belt 494' is sleeved between the second driving wheel 492' and the second main driving wheel 493', so that the second driving wheel 492' and the second main driving wheel 493' rotate synchronously. The second auxiliary transmission wheel 495' is mounted on another end of the second transmission shaft 491' to rotate synchronously with the second transmission shaft 491'. The second driven wheel 496' is mounted on the second turntable 421' to rotate synchronously with the second turntable 421'. The fourth transmission belt 497' is sleeved between the second auxiliary transmission wheel 495' and the second driven wheel 496', so that the second auxiliary transmission wheel 495' and the second driven wheel 496' rotate synchronously. This way, the outputting shaft of the twelfth driving member 49' rotates to drive the second driving wheel 492', the second main driving wheel 493', the second driving shaft 491', the second auxiliary driving wheel 495', the second driven wheel 496', and the second turntable 421' to rotate in turn. It should be noted that a transmission connection between the second transmission shaft 491' and the twelfth driving member 49' and the second turntable 421' is not limited to use of belt transmission; in other embodiments, for example, gear transmission, chain transmission, etc., may also be used, which is not limited here.

Furthermore, the above-mentioned second transmission shaft 491' may be a hollow shaft. The second transmission shaft 491' is coaxially sleeved outside of the second swing shaft 47', and is rotatable relative to the second swing shaft 47'. This way, the second transmission shaft 491' and the second swing shaft 47' are sleeved to make a structure more compact, which is beneficial to simplify the structure and reduce occupied space. Optionally, the second transmission shaft 491' may be coaxially mounted outside of the second swing shaft 47' through a bearing.

Specifically, in one embodiment, the second strip connection mechanism 40' further includes a second sliding plate 451' and a second shaft mounting seat 452'. The second sliding plate 451' is fixedly connected to the third sliding block 45'. The eleventh driving member 48' is fixedly mounted on the second sliding plate 451'. The second shaft mounting seat 452' is fixedly connected to the second sliding plate 451'. The second swing shaft 47' is rotatably connected to the second shaft mounting seat 452' around its own axis. The second transmission shaft 491' is sleeved outside of the second swing shaft 47'. The twelfth driving member 49' is fixedly mounted on the second shaft mounting seat 452'. Optionally, the third sliding block 45' may include two or more than two, so as to further improve stability of an action of the strip connection mechanism 40'.

Specifically, in one embodiment, the second clamping component 42' further includes a second rotating shaft 427', and the second rotating shaft 427' is rotatably connected to the moving member 41' around its own axis. The second turntable 421' is fixedly connected to the second rotating shaft 427', so as to rotate synchronously with the second rotating shaft 427'. The second driven wheel 496' is fixedly mounted on the second rotating shaft 425', so as to rotate synchronously with the second rotating shaft 427'. Furthermore, the second rotating shaft 427' is defined with a central hole along its axis; and an air path of the ninth driving member 424' penetrates through the central hole of the second rotating shaft 427', and is connected with an air joint. This way, entanglement of the air path caused by the rotation of the second rotating shaft 427' can be avoided.

In some embodiments, the strip connection mechanism 40' further includes a second cutting driving member 431' and a second cutting tool holder 432'. The second cutting driving member 431' is fixedly mounted on the moving member 41', and the second cutting tool holder 432' is fixedly mounted on a driving end of the second cutting driving member 431' and faces the second clamping component 42'. The second cutting tool 43' is mounted on an end of the second cutting tool holder 432' facing the second clamping component 42'. The second cutting driving member 431' drives the second cutting tool holder 432' to approach or move away from the second clamping component 42', making the second cutting tool 43' cut off the work material strip clamped by the clamping plate 423' and the first clamping rollers 422'; and then returns to an initial position. Optionally, the second cutting driving member 431' may be a cylinder.

Figure 16:
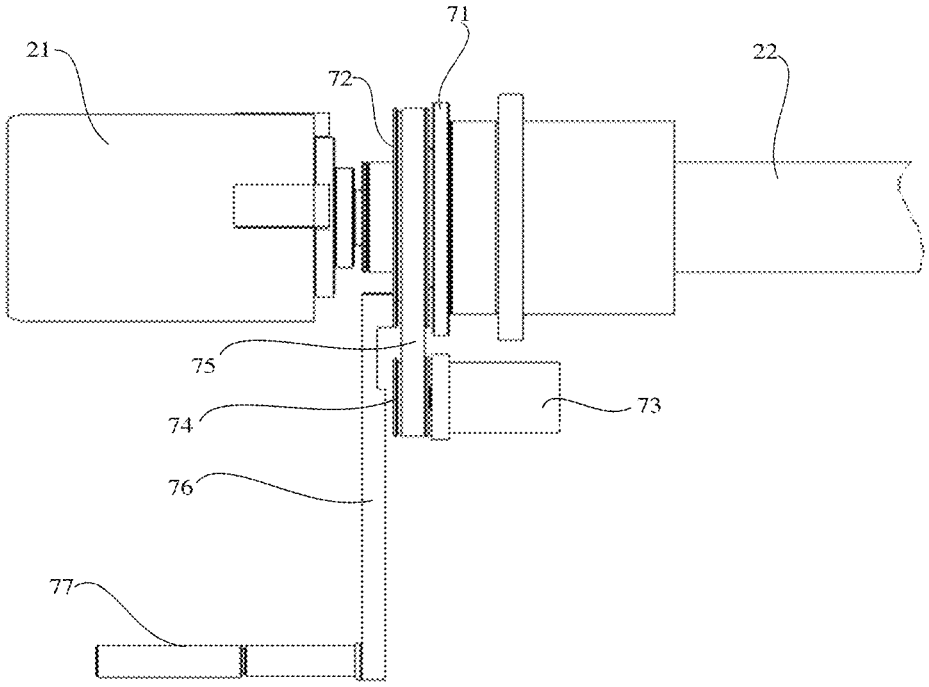
FIG. 16 is a side view of a guiding component of the automatic roll replacing device shown in FIG. 1.
Figure 17:
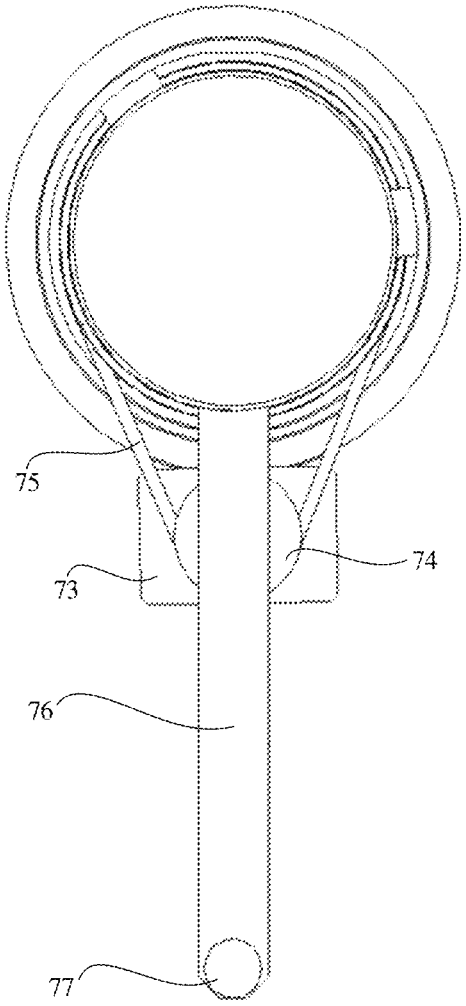
FIG. 17 is a front view of the guiding component shown in FIG. 16.

Referring to FIG. 3, FIG. 16, and FIG. 17, in the embodiment of the present application, the unwinding mechanism further includes a guiding component for guiding the work material strip unwound from the unwinding shaft 21. The guiding component includes a supporting base 71, a rotating wheel 72, a guiding driving member 73, a rotating arm 76, and a guiding roller 77.

The supporting base 71 is fixedly connected to the mounting frame 10 and has a shaft hole for the first guiding post 22 to pass through. Since the supporting base 71 is fixed relative to the mounting frame 10, the first guiding post 22 is movable relative to the mounting frame 10 along its own axis, so the first guiding post 22 is movable relative to the supporting base 71 along its own axis. The rotating wheel 72 is rotatably connected to the supporting base 71 around an axis of the shaft hole. The guiding driving member 73 is disposed on the mounting frame 10 and is connected to the rotating wheel 72 in a transmission manner, so as to drive the rotating wheel 72 to rotate around the axis of the shaft hole. One end of the rotating arm 76 is fixedly connected to the rotating wheel 72, and the guiding roller 77 is provided on another end of the rotating arm 76. This way, the guiding driving member 73 can drive the rotating wheel 72 to rotate, thereby driving the rotating arm 76 and the guiding roller 77 to rotate with the rotating wheel 72, and then a position of the guiding roller 77 can be adjusted to guide the work material strip. Compared with the guiding roller 77 moving in a straight line in the prior art, since the guiding roller 77 is mounted through a rotating structure in this embodiment, and the supporting seat 71 can be sleeved on the first guiding post 22 through the shaft hole, making a structure more compact, reducing occupied space, and more flexible to use.

Specifically, in the embodiment, the axis of the shaft hole is collinear with the axis of the unwinding shaft 21, so that a position adjustment of the guiding roller 77 is more flexible, and the occupied space is further reduced. Furthermore, an axis of the guiding roller 77 is parallel to the axis of the shaft hole, that is, the guiding roller 77 is parallel to the unwinding shaft 21, so as to better guide the material strip unwound from the unwinding shaft 21.

Specifically, in the embodiment, the rotating arm 76 extends longitudinally in a direction perpendicular to the axis of the shaft hole.

In some embodiments, the guiding component further includes a guiding driving wheel 74 and a guiding transmission belt 75. The guiding driving wheel 74 is mounted on an outputting shaft of the guiding driving member 73 to rotate synchronously with the outputting shaft of the guiding driving member 73. The guiding transmission belt 75 is sleeved between the guiding driving wheel 74 and the rotating wheel 72, so that the guiding driving wheel 74 and the rotating wheel 72 rotate synchronously. That is, the guiding driving member 73 drives the rotating wheel 72 to rotate by means of belt transmission. Optionally, the guiding driving member 73 may be a motor.

In some embodiments, the supporting base 71 includes a mounting portion and a shaft portion fixedly connected to one side of the mounting portion. The shaft hole penetrates the mounting portion and the shaft portion in sequence. The mounting portion is used to be fixedly mounted on the mounting frame 10. The rotating wheel 72 is rotatably sleeved outside of the shaft portion. In specific embodiments, the rotating wheel 72 can be sleeved on the shaft portion through a bearing. The mounting portion may be mounted on the mounting frame 10 by some means, for example, welding, threaded fasteners, and the like.

Figure 18:
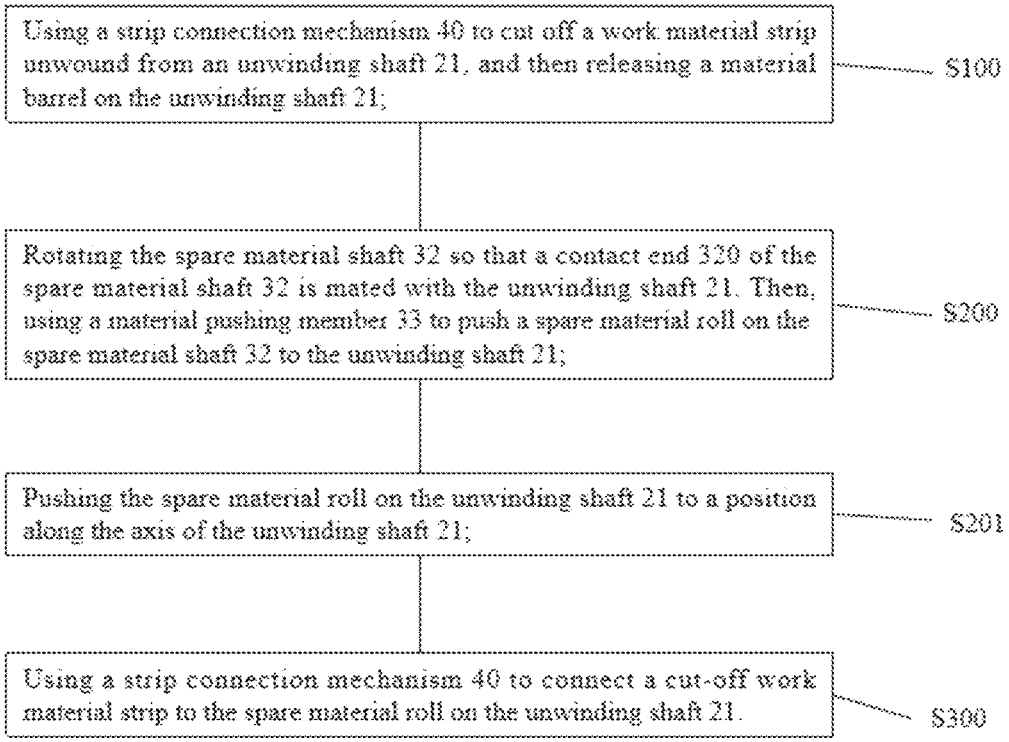
FIG. 18 is a flow chart of a roll replacing method of the automatic roll replacing device shown in FIG. 1.
Figure 19:
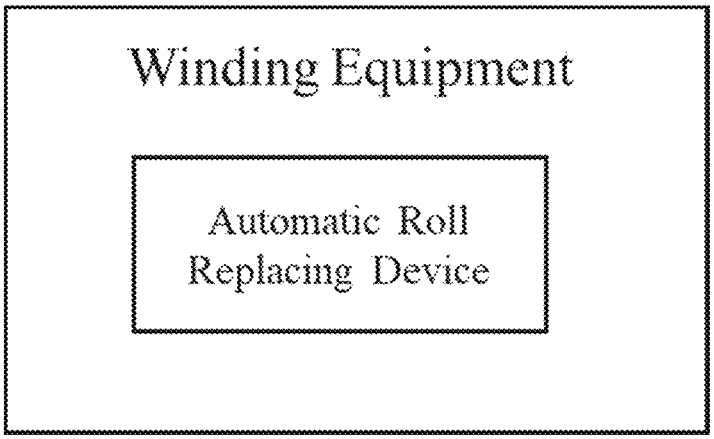
FIG. 19 is a block diagram of a winding equipment according to some embodiments of the present disclosure.

Please refer to FIG. 18, based on the above-mentioned automatic roll replacing device, the present application further provides a roll replacing method. As follows, taking the automatic roll replacing device using the strip connection mechanism 40 in the first embodiment as an example, the roll replacing method includes steps of:

S100: Using a strip connection mechanism 40 to cut off a work material strip unwound from an unwinding shaft 21, and then releasing a material barrel on the unwinding shaft 21.

Specifically, the sixth driving member 46 drives the second sliding block 45 to move in a direction parallel to the second axis (i.e., a direction parallel to the axis of the unwinding shaft 21), the work material strip is inserted between the fixed clamping roller and the movable clamping roller. Then the fifth driving member drives the movable clamping roller to move toward the fixed clamping roller, thereby clamping the work material strip. Then, the first cutting driving member 431 drives the first cutting tool to cut off the work material strip.

The second driving member 622 drives the rotary shaft 621 to rotate, and drives the gripper 624 to the grabbing position. The gripper 624 grabs the material barrel on the unwinding shaft 21, that is, the material barrel is fixed relative to the gripper 624. The unwinding shaft 21 is then to move along its axis, so that the material barrel is separated from the unwinding shaft 21. Then, the second driving member 622 drives the rotary shaft 621 to rotate, and drives the gripper 624 to the discharge position. At this time, the gripper 624 releases the material barrel, and the material barrel falls into the material storage area and is collected.

Furthermore, in order to facilitate insertion of the work material strip between the fixed clamping roller and the movable clamping roller, the rotating wheel 72 of the guiding component can be rotated to adjust a position of the work material strip by using the guiding roller 77, making the work material strip align with gaps between the fixed clamping roller and the movable clamping roller.

S200: Rotating the spare material shaft 32 so that a contact end 320 of the spare material shaft 32 is mated with the unwinding shaft 21. Then, using a material pushing member 33 to push a spare material roll on the spare material shaft 32 to the unwinding shaft 21.

Specifically, the spare material shaft 32 is rotated, so that the contact end 320 of the spare material shaft 32 faces the unwinding shaft 21. Then, the unwinding shaft 21 is driven to move toward the contact end 320 along its own axis, so that the unwinding shaft 21 is brought into contact with the contact end 320 for mating. The material pushing member 33 on the spare material shaft 32 moves along the spare material shaft 32 so as to push the spare material roll on the spare material shaft 32 to the unwinding shaft 21.

S300: Using a strip connection mechanism 40 to connect a cut-off work material strip to the spare material roll on the unwinding shaft 21.

Specifically, the eighth driving member 49 drives the first turntable 421 to rotate, so that a part of the work material strip is wrapped on the fixed clamping roller 422 or the movable clamping roller 423.

The seventh driving member 48 drives the second swing arm 41 to rotate around the first swing shaft 47, so that the above-mentioned fixed clamping roller 422 or the movable clamping roller 423 wrapped with the part of the work material strip is in contact with the spare material roll on the unwinding shaft 21, so that the work material strip is bonded to the spare material roll (to facilitate connection of the material strip, a beginning end of the spare material strip of the spare material roll is provided with double-sided tape, and the double-sided tape is used to bond with the work material strip). The unwinding shaft 21 rotates to drive the spare material roll on the unwinding shaft 21 to rotate, and then drives the fixed clamping roller 422 or the movable clamping roller 423 to rotate around its own axis through the work material strip, so that an entire tail end of the work material strip is pasted on the spare material roll. Then, the fifth driving member drives the movable clamping roller to move away from the fixed clamping roller, thereby releasing the work material strip.

The sixth driving member 46 drives the second sliding block 45 to move in a direction parallel to the second axis, and the seventh driving member 48 drives the second swing arm 41 to rotate around the swing shaft 47, so that the strip connection mechanism 40 returns to its original position.

Furthermore, in order to avoid driving the work material strip, during a process of the strip connection mechanism 40 returning to the original position, the guiding roller 77 of the guiding component can be used to lift the work material strip, so that the work material strip is separated from the strip connection mechanism 40. After the strip connection mechanism 40 returns to its original position, the guiding roller 77 of the guiding component drives the work material strip to a suitable position for unwinding.

In some embodiments, step S201 is further included after step S200: pushing the spare material roll on the unwinding shaft 21 to a position along the axis of the unwinding shaft 21.

In one embodiment, step S201 specifically includes: moving the unwinding shaft 21 along its axis in a direction facing away from the spare material shaft 32, and rotating the spare material shaft 32, so that the pushing member 53 on the spare material shaft 32 faces the unwinding shaft 21. The unwinding shaft 21 moves along its axis in a direction close to the spare material shaft 32, so that the pushing member 53 pushes the spare material roll on the unwinding shaft 21 to the position (that is, the spare material roll contacts the positioning block 27). It can be understood that movement of the unwinding shaft 21 in the direction away from the spare material shaft 32 along its own axis is to make way for the spare material shaft 32, to prevent the spare material shaft 32 from rotating, so that the pushing member 53 on the spare material shaft 32 faces the unwinding shaft 21 and interferes with the pushing member 53.

In another embodiment, step S201 specifically includes: moving the unwinding shaft 21 along its own axis in a direction away from the spare material shaft 32. The pushing shaft 52 of the pushing mechanism rotates around its own axis to drive the pushing member 53 to rotate to the pushing position, that is, the pushing member 53 is located between the spare material shaft 32 and the unwinding shaft 21. The unwinding shaft 21 moves along its own axis to the direction close to the spare material shaft 32, so that the pushing member 53 pushes the spare material roll on the unwinding shaft 21 to the position (that is, the spare material roll contacts the positioning block 27).

It should be noted that when the contact end 320 of the spare material shaft 32 faces away from the unwinding shaft 21, the contact end 320 of the spare material shaft 32 can be docked with a feeding device such as an AGV (Automated Guided Vehicle), so as to load one or more spare material rolls on the spare material shaft 32.

Based on the above-mentioned automatic roll changing device, the present application also provides a winding equipment. The winding equipment includes the automatic winding replacing device as described in any of the above-mentioned embodiments.

The various embodiments in this specification are described in a progressive manner, and each embodiment focuses on differences from other embodiments, and same and similar parts between the various embodiments can be referred to each other.

The above-mentioned description of the disclosed embodiments enables those skilled in the art to make or use the present application. Various modifications to these embodiments will be apparent to those skilled in the art, the general principles defined here may be implemented in other embodiments without departing from a spirit or scope of the present application. Therefore, the present application is not to be limited to the embodiments shown here, but is to be accorded the widest scope consistent with the principles and novel features disclosed here.

What is claimed is:

1. An automatic roll replacing device, comprising:

a mounting frame;

an unwinding mechanism comprising an unwinding shaft rotatably connected to the mounting frame around its own axis;

a spare material mechanism comprising a spare material shaft having a contact end and a material pushing member providing axial pushing force for a spare material roll on the spare material shaft; the spare material shaft is rotatably connected to the mounting frame around a rotation axis; a material pushing position is provided during a process of the spare material shaft rotating around the rotation axis, when the spare material shaft is located at the material pushing position, the contact end connects with the unwinding shaft, the material pushing member is controlled to push the spare material roll on the spare material shaft to transfer to the unwinding shaft; and a strip connection mechanism, provided on the mounting frame, and used to cut off a work material strip unwound from the unwinding shaft and connect a cut-off work material strip to the spare material roll; wherein the unwinding mechanism further comprises a first guiding post and a rotating shaft, the first guiding post is movably connected to the mounting frame along its own axis, the rotating shaft is fixed in an axial direction and is rotatably fitted in the first guiding post in a circumferential direction, the unwinding shaft is fixedly connected to one end of the rotating shaft.

2. The automatic roll replacing device as claimed in claim 1, wherein the unwinding mechanism further comprises a first driving component and a second driving component;

the first driving component is disposed on the mounting frame, and is connected with the first guiding post by transmission; the second driving component is disposed on the first guiding post, and is connected with another end of the rotating shaft by transmission, so as to drive the rotating shaft to rotate around its own axis.

3. The automatic roll replacing device as claimed in claim 2, wherein the unwinding mechanism further comprises a conveying roller component, the conveying roller component comprises a second guiding post and a conveying roller, the second guiding post is movably connected to the mounting frame along a direction in parallel with the first guiding post, and the second guiding post and the first guiding post are controllably connected to or separated from each other;

the conveying roller is mounted on the second guiding post, and is used to guide a material strip unwound from the unwinding shaft.

4. The automatic roll replacing device as claimed in claim 3, wherein a driving portion is fixedly connected to the first guiding post, a mounting member is fixedly connected to the second guiding post;

the conveying roller component further comprises a fixing holding member and a movable holding member, the fixing holding member is mounted on the mounting member, and abuts against one side of the driving portion; the movable holding member is movably connected to the mounting member, and the movable holding member can abut against another side of the driving portion during a moving process.

5. The automatic roll replacing device as claimed in claim 2, wherein the unwinding mechanism further comprises a guiding component, the guiding component comprises a supporting base, a rotating wheel, a guiding driving member, a rotating arm, and a guiding roller;

the supporting base is fixedly mounted on the mounting frame, and provides a shaft hole for the first guiding post to pass through; the rotating wheel is rotatably connected to the supporting base around an axis of the shaft hole; the guiding driving member is mounted on the mounting frame, and is connected with the rotating wheel by transmission; one end of the rotating arm is fixedly connected to the rotating wheel; and the guiding roller is disposed on another end of the rotating arm.

6. The automatic roll replacing device as claimed in claim 1, wherein the automatic roll replacing device further comprises a pushing mechanism, the pushing mechanism comprises a pushing shaft and a pushing member, the pushing shaft is rotatably connected to the mounting frame around its own axis, the pushing member is mounted on the pushing shaft;

a pushing position is provided during a process of the pushing shaft being rotatably connected to the mounting frame around its own axis; when the pushing member is located at the pushing position, the pushing member is located between the unwinding shaft and the spare material shaft, and is used to push the spare material roll on the unwinding shaft.

7. The automatic roll replacing device as claimed in claim 1, wherein the automatic roll replacing device further comprises a waste collecting mechanism, the waste collecting mechanism comprises a grabbing component rotatably connected to the mounting frame around a first axis;

a grabbing position and a discharge position are provided during a process of the grabbing component being rotatably connected to the mounting frame around the first axis, when the grabbing component is located at the grabbing position, the grabbing component is used to grab a material barrel on the unwinding shaft; when the grabbing component is located at the discharge position, the grabbing component releases the material barrel.

8. The automatic roll replacing device as claimed in claim 7, wherein the grabbing component comprises a rotary shaft, a second driving member, a first swing arm, and a gripper; the rotary shaft is rotatably disposed around its own axis, the second driving member is connected with the rotary shaft by transmission, one end of the first swing arm is fixedly connected to the rotary shaft, the gripper is disposed on another end of the first swing arm.

9. The automatic roll replacing device as claimed in claim 7, wherein the waste collecting mechanism further comprises a storage component, the storage component is located below the grabbing component, the storage component comprises a sliding seat, the sliding seat is provided with a plurality of material storage areas at intervals in a first direction, the sliding seat is slidably disposed along the first direction, so as to drive the plurality of material storage areas to sequentially move below the discharge position.

10. The automatic roll replacing device as claimed in claim 1, wherein the spare material shaft is a hollow shaft, at least one chute is defined on a circumferential side wall of the spare material shaft, the chute extends longitudinally along an axial direction of the spare material shaft;

the material pushing member is slidably disposed in the spare material shaft along the axial direction of the spare material shaft, and extends out of the spare material shaft from the corresponding chute;

the spare material mechanism further comprises a material pushing driving component, the material pushing driving component comprises a material pushing lead screw, a material pushing lead screw nut, and a material pushing driving member;

the material pushing lead screw is disposed in the spare material shaft, and is rotatable relative to the spare material shaft, the material pushing lead screw nut is threadedly connected to the material pushing lead screw, the material pushing member and the material pushing lead screw nut are relatively fixedly disposed, the material pushing driving member is mounted on one end of the spare material shaft, and is connected with the material pushing lead screw by transmission.

11. The automatic roll replacing device as claimed in claim 1, wherein the strip connection mechanism comprises a second swing arm, a first clamping component, and a first cutting tool;

one end of the second swing arm is rotatably connected to the mounting frame around a second axis parallel to the axis of the unwinding shaft, the first clamping component is rotatably connected to another end of the second swing arm around a third axis parallel to the second axis, the first clamping component is used to clamp the work material strip, the first cutting tool is disposed on the second swing arm, and can approach or move away from the first clamping component, the first cutting tool is used to cut off the work material strip.

12. The automatic roll replacing device as claimed in claim 11, wherein the first clamping component comprises a first turntable, a fixed clamping roller, and a movable clamping roller, the first turntable is rotatably connected to the one end of the second swing arm around the third axis, the fixed clamping roller is mounted on the first turntable, the movable clamping roller can be connected to the first turntable approaching or moving away from the fixed clamping roller.

13. The automatic roll replacing device as claimed in claim 12, wherein the strip connection mechanism further comprises a first fixing frame, a second sliding block, and a sixth driving member;

the first fixing frame is fixedly connected to the mounting frame, the second sliding block is movably connected to the first fixing frame along a direction parallel to the second axis, one end of the second swing arm away from the first clamping component is rotatably connected to the second sliding block around the second axis, the sixth driving member is mounted on the first fixing frame and is connected with the second sliding block by transmission.

14. The automatic roll replacing device as claimed in claim 13, wherein the strip connection mechanism further comprises a first swing shaft and a seventh driving member, the first swing shaft is rotatably connected to the second sliding block around its own axis, one end of the second swing arm away from the first clamping component is fixedly connected to the first swing shaft, the seventh driving member is disposed on the second sliding block and is connected with the first swing shaft by transmission.

15. The automatic roll replacing device as claimed in claim 14, wherein the first clamping component further comprises an eighth driving member and a first transmission component, the eighth driving member is fixedly mounted relative to the second sliding block, the first transmission component is connected between the eighth driving member and the first turntable by transmission;

the first transmission component comprises a first transmission shaft, the first transmission shaft is connected with the eighth driving member and the first turntable respectively by transmission;

the first transmission shaft is a hollow shaft, the first transmission shaft is coaxially sleeved outside of the first swing shaft and is rotatable relative to the first swing shaft.

16. The automatic roll replacing device as claimed in claim 1, wherein the strip connection mechanism comprises:

a moving member, movably connected to the mounting frame approaching or moving away from the spare material roll;

a second clamping component comprising a second turntable, at least two first clamping rollers, and a clamping plate, the second turntable is rotatably connected to the moving member around a third axis, the clamping plate is disposed on the second turntable, each of the first clamping rollers is disposed on the second turntable; at least one of the at least two first clamping rollers and the clamping plate can approach or move away from another of the at least two first clamping rollers and the clamping plate under an action of external force, so as to form a clamping position for clamping the work material strip between the at least two first clamping rollers and the clamping plate; and a second cutting tool, disposed on the moving member, and can cut into or out of the clamping position between any two adjacent first clamping rollers.

17. The automatic roll replacing device as claimed in claim 16, wherein one side of the clamping plate facing the at least two first clamping rollers is provided with a clamping surface, each of the first clamping rollers is disposed at intervals along the clamping surface, and the first clamping rollers are parallel to each other.

18. The automatic roll replacing device as claimed in claim 17, wherein the second clamping component comprises two of the first clamping rollers, a cutting channel for the second cutting tool to pass through is defined between the two of the first clamping rollers; the clamping surface is provided with an avoidance slot corresponding to the cutting channel.

19. The automatic roll replacing device as claimed in claim 1, wherein the spare material mechanism further comprises a pushing block, the spare material shaft is further provided with a pushing end opposite to the contact end, the pushing block is fixedly connected to the pushing end;

a spare material position is further provided in a process of the spare material shaft rotating around the rotation axis; when the spare material shaft is located at the spare material position, the pushing block faces the unwinding shaft, so as to push the spare material roll on the unwinding shaft.

20. A winding equipment, comprising an automatic roll replacing device, comprising:

a mounting frame;

an unwinding mechanism comprising an unwinding shaft rotatably connected to the mounting frame around its own axis;

a spare material mechanism comprising a spare material shaft having a contact end and a material pushing member providing axial pushing force for a spare material roll on the spare material shaft; the spare material shaft is rotatably connected to the mounting frame around a rotation axis; a material pushing position is provided during a process of the spare material shaft rotating around the rotation axis, when the spare material shaft is located at the material pushing position, the contact end connects with the unwinding shaft, the material pushing member is controlled to push the spare material roll on the spare material shaft to transfer to the unwinding shaft; and a strip connection mechanism, provided on the mounting frame, and used to cut off a work material strip unwound from the unwinding shaft and connect a cut-off work material strip to the spare material roll; wherein the unwinding mechanism further comprises a first guiding post and a rotating shaft, the first guiding post is movably connected to the mounting frame along its own axis, the rotating shaft is fixed in an axial direction and is rotatably fitted in the first guiding post in a circumferential direction, the unwinding shaft is fixedly connected to one end of the rotating shaft.

* * * * *